US010451336B2

(12) United States Patent
Ribeiro et al.

(10) Patent No.: US 10,451,336 B2
(45) Date of Patent: Oct. 22, 2019

(54) ADJUSTABLE REFRIGERATOR COMPARTMENT AND DOOR ASSEMBLY

(71) Applicant: WHIRLPOOL CORPORATION, Benton Harbor, MI (US)

(72) Inventors: Bruno de Mello Ribeiro, Joinville (BR); Rafael da Cunha Schmidt, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/782,058

(22) Filed: Oct. 12, 2017

(65) Prior Publication Data

US 2019/0113270 A1 Apr. 18, 2019

(51) Int. Cl.

| | |
|---|---|
| ***F25D 23/06*** | (2006.01) |
| ***F25D 23/02*** | (2006.01) |
| *F25D 11/02* | (2006.01) |
| *F25D 25/04* | (2006.01) |

(52) U.S. Cl.

CPC ..... *F25D 23/067* (2013.01); *F25D 23/021* (2013.01); *F25D 23/025* (2013.01); *F25D 23/069* (2013.01); *F25D 11/02* (2013.01); *F25D 25/04* (2013.01); *F25D 2400/04* (2013.01); *F25D 2400/16* (2013.01)

(58) Field of Classification Search

CPC .... F25D 23/067; F25D 23/021; F25D 23/069; F25D 11/02; F25D 2400/04; F25D 25/02; F25D 25/024

See application file for complete search history.

(56) References Cited

U.S. PATENT DOCUMENTS

| | | | | |
|---|---|---|---|---|
| 4,217,010 | A * | 8/1980 | Webb | F25D 11/02 312/312 |
| 4,876,860 | A | 10/1989 | Negishi | |
| 5,199,778 | A | 4/1993 | Aoki et al. | |
| 5,577,822 | A | 11/1996 | Seon | |
| 5,913,584 | A | 6/1999 | Swindell et al. | |
| 6,547,349 | B2 | 4/2003 | Sessa et al. | |
| 7,293,422 | B2 | 11/2007 | Parachini et al. | |
| 8,172,347 | B2 | 5/2012 | Lim et al. | |
| 8,359,881 | B2 | 1/2013 | Junge et al. | |
| 8,529,001 | B2 | 9/2013 | Calvillo et al. | |

(Continued)

*Primary Examiner* — Hanh V Tran

(74) *Attorney, Agent, or Firm* — Price Heneveld LLP

(57) ABSTRACT

A refrigerator includes a cabinet with an adjustable wall partitioning the cabinet between first and second storage compartments. An adjustment mechanism is coupled to the adjustable wall and includes a mounting portion that is slideably coupled to an underside of the adjustable wall between fore and aft positions. A retaining mechanism is operably coupled to the mounting portion and includes a plurality of engagement features that engage like engagement features disposed on the underside of the adjustable wall. The retaining mechanism is moved to the disengaged position to allow movement of the adjustment mechanism between the fore and aft positions. The adjustment mechanism further includes support guides downwardly extending from opposite sides of the mounting portion. The support guides are slideably received in inclined channels disposed on opposite sidewalls of the cabinet between raised and lowered positions as the adjustment mechanism moves between the fore and aft positions.

20 Claims, 22 Drawing Sheets

(56) References Cited

U.S. PATENT DOCUMENTS

| | | | | |
|---|---|---|---|---|
| 2007/0096610 | A1* | 5/2007 | Filho | A47B 57/10 312/408 |
| 2009/0121600 | A1* | 5/2009 | Eisele | F25D 23/067 312/408 |
| 2009/0308098 | A1* | 12/2009 | An | F25D 25/02 62/449 |
| 2010/0066227 | A1* | 3/2010 | Ramm | A47B 51/00 312/408 |
| 2010/0176703 | A1* | 7/2010 | Kim | F25D 25/02 312/408 |
| 2011/0031863 | A1* | 2/2011 | Benitsch | A47B 57/06 312/408 |
| 2013/0081421 | A1* | 4/2013 | Kwon | F25D 23/04 62/440 |
| 2014/0042886 | A1* | 2/2014 | Baldo | F25D 25/02 312/405.1 |
| 2015/0076985 | A1* | 3/2015 | Yoo | F25D 25/02 312/408 |
| 2015/0168048 | A1 | 6/2015 | Sexton et al. | |
| 2015/0276304 | A1* | 10/2015 | Choo | F25D 25/02 312/408 |
| 2015/0300726 | A1* | 10/2015 | Yi | F25D 23/062 312/317.3 |
| 2015/0300728 | A1* | 10/2015 | Kim | F25D 25/024 312/408 |
| 2016/0047594 | A1* | 2/2016 | Choo | F25D 25/02 312/404 |
| 2016/0161174 | A1* | 6/2016 | Yi | F25D 23/067 62/285 |
| 2016/0187052 | A1* | 6/2016 | Park | F25D 25/024 312/408 |
| 2016/0270536 | A1* | 9/2016 | Ferreira | A47B 96/068 |

* cited by examiner

ADJUSTABLE REFRIGERATOR COMPARTMENT AND DOOR ASSEMBLY

BACKGROUND

A conventional refrigerator typically includes a cabinet having one or more sub-compartments, such as a freezer compartment and a refrigerator compartment. The compartments may be arranged side-by-side or top-to-bottom, and separated by an insulated shelf, or mullion wall. The refrigerator may also include one or more shelves and drawers for separating the compartments and providing different areas and surfaces for storing food. In addition, a conventional refrigerator typically includes one or more doors for accessing the storage compartments and for sealing the compartments to prevent cold air leakage. The ability to adjust the size of the sub-compartments is desired and a door that can expand and contract with the changing size of one or more of the sub-compartments is also desired.

SUMMARY

In at least one aspect, a refrigerator is described and includes a cabinet with an adjustable wall partitioning the cabinet between first and second storage compartments. The adjustable wall includes an underside having a plurality of engagement features disposed thereon. An adjustment mechanism is coupled to the adjustable wall and includes a mounting portion that is slideably coupled to the underside of the adjustable wall between fore and aft positions. A retaining bar is operably coupled to the mounting portion and includes a plurality of reciprocal engagement features to the engagement features of the adjustable wall. In use, the retaining bar is moveable between engaged and disengaged positions relative to the adjustable wall for allowing movement of the adjustment mechanism between the fore and aft positions.

In at least another aspect, a refrigerator is described and includes a cabinet having first and second sidewalls spaced-apart from one another and an adjustable wall disposed within the cabinet that is configured for vertical movement within the cabinet. An adjustment mechanism is coupled to an underside of the adjustable wall and includes a mounting portion that is slideably coupled to the underside of the adjustable wall between fore and aft positions. The mounting portion is also slideably coupled to the first and second sidewalls of the cabinet between raised and lowered positions. A retaining bar is operably coupled to the mounting portion and configured to pivot between engaged and disengaged positions relative to the adjustable wall. One or more retaining blocks are operably coupled to the retaining bar and upwardly extend therefrom. The one or more retaining blocks are received in one or more retaining slots disposed on the underside of the adjustable wall to retain the adjustment mechanism in one of several predetermined positions along the underside of the adjustable wall.

In at least another aspect, a refrigerator is described and includes a cabinet having a first sidewall with a first channel disposed on an inner surface thereof, and a second sidewall spaced-apart from the first sidewall with a second channel disposed on an inner surface thereof. An adjustable wall seals against the first and second sidewalls and partitions the cabinet between first and second storage compartments. An adjustment mechanism is coupled to the adjustable wall and includes a mounting portion that is slideably coupled to an underside of the adjustable wall between fore and aft positions. The mounting portion further includes first and second support guides downwardly extending from opposite sides of the mounting portion, wherein the first and second support guides are slideably received in the first and second channels of the first and second sidewalls, respectively, between raised and lowered positions.

These and other features, advantages, and objects of the present device will be further understood and appreciated by those skilled in the art upon studying the following specification, claims, and appended drawings.

DETAILED DESCRIPTION OF EMBODIMENTS

Figure 1:
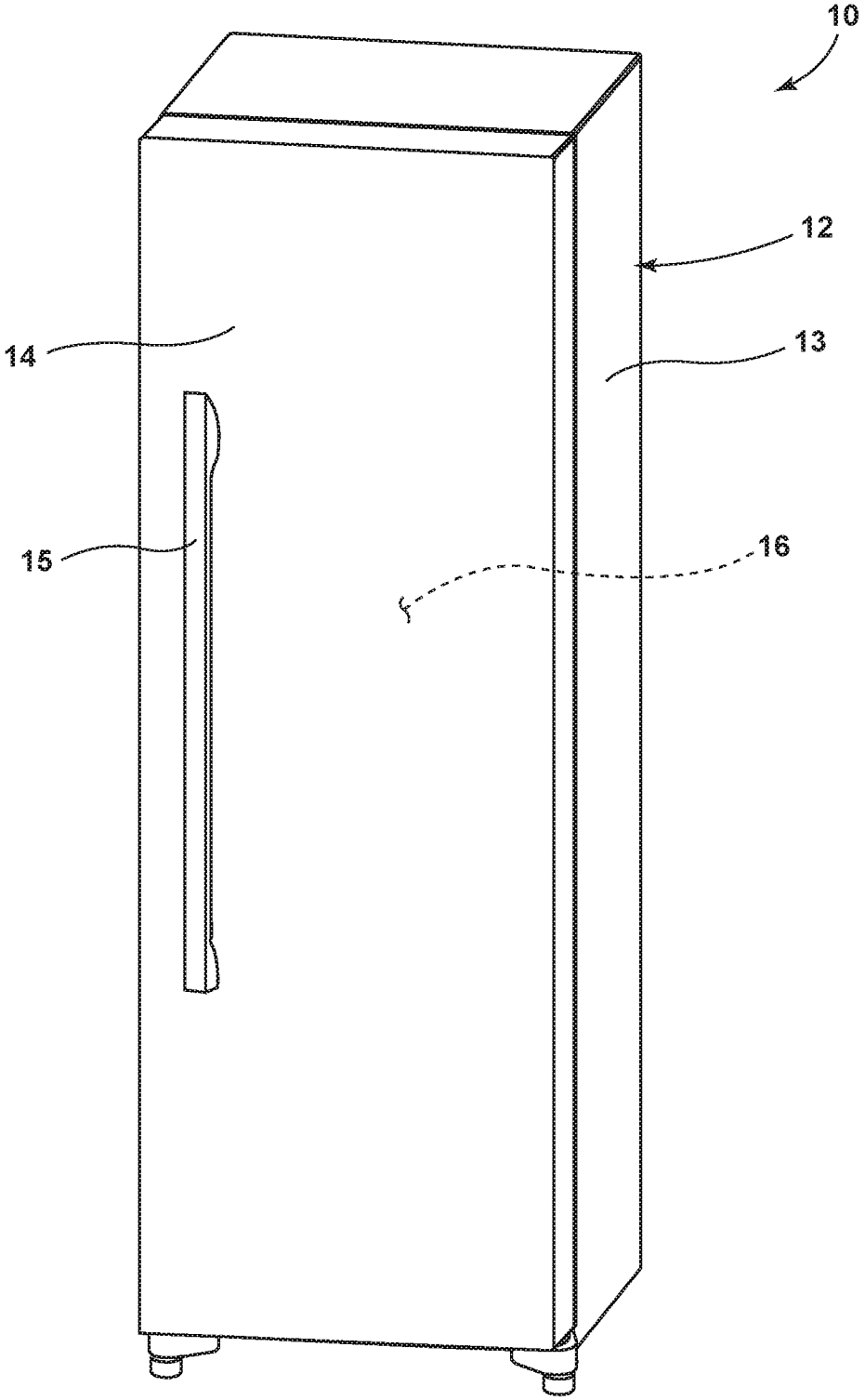
FIG. 1 is a top perspective view of a refrigerator, according to an embodiment described herein.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIG. 1, a refrigerator 10 is shown having a cabinet 12 with an outer shell or exterior wrapper 13. An exterior door 14 is coupled to the cabinet 12. The exterior door 14 includes a handle 15 disposed on an outer surface thereof to be engaged by a user to move the exterior door 14. In the embodiment shown in FIG. 1, the exterior door 14 is illustrated in a closed position relative to the cabinet 12. The exterior door 14 can be moved by a user to an open position to provide access to a storage compartment 16 defined by and positioned within the cabinet 12.

Figure 2:
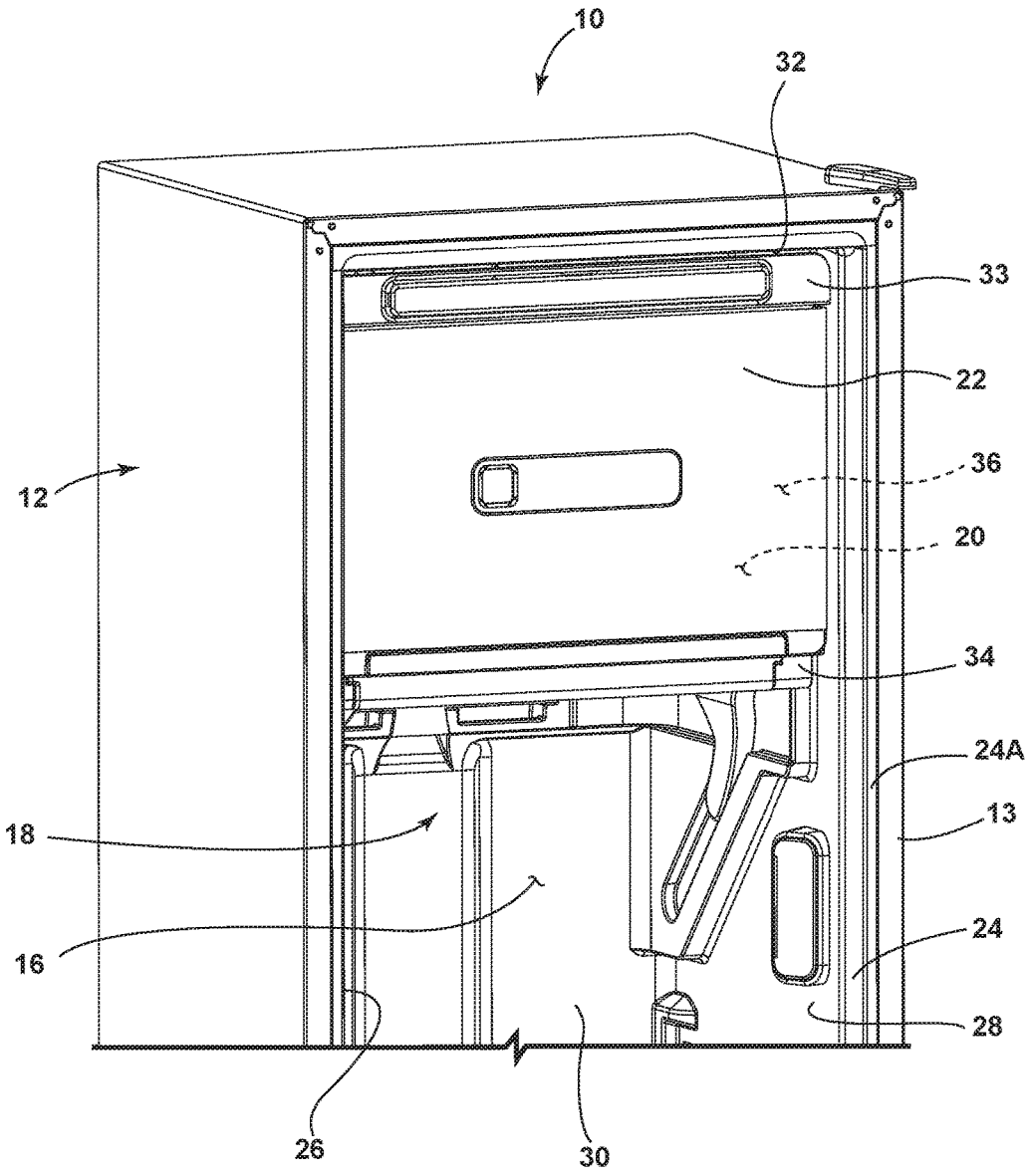
FIG. 2 is a top perspective view of the refrigerator of FIG. 1 with a front door removed to reveal an inner door in a closed position according to an embodiment described herein.

Referring now to FIG. 2, the refrigerator 10 is shown having the exterior door 14 removed therefrom to reveal the storage compartment 16 of the cabinet 12. The storage compartment 16 may be divided into several sub compartments which, in the embodiment shown in FIG. 2, includes a main compartment 18 and an interior compartment 20. In the embodiment shown in FIG. 2, it is contemplated that the main compartment 18 may be a refrigerator compartment for storing fresh food items. The interior compartment 20 may be a freezer compartment that is independently controlled with regards to temperature relative to the main compartment 18 for storing frozen food items. In the embodiment shown in FIG. 2, the interior compartment 20 includes a door 22 that is operable between open and closed positions to selectively provide access to the interior compartment 20. In this way, the door 22 is an interior door that is accessed when the exterior door 14 (FIG. 1) is opened. The interior compartment 20 is adjustable in size, as further described below, and the door 22 is also adjustable in size to accommodate the varying parameters of the interior compartment 20. The adjustable relationship between the door 22 and the interior compartment 20 is further described below.

With further reference to FIG. 2, the refrigerator 10 further includes an inner liner 24 having first and second sidewalls 26, 28 that are spaced-apart and interconnected by a rear wall 30. As shown in FIG. 2, the liner 24 is coupled to the exterior wrapper 13 at a front portion 24A of the liner 24. The liner 24 further includes a top wall 32 that also interconnects the first and second sidewalls 26, 28 and is further coupled to the rear wall 30. Together, the sidewalls 26, 28, the rear wall 30 and the top wall 32 (along with a bottom wall not shown) of the liner 24 cooperate to generally define the parameters of the storage compartment 16. The interior compartment 20 includes an adjustable bottom wall 34 which serves as a sealed partition between the main compartment 18 and the interior compartment 20, which are both disposed within the storage compartment 16. The adjustable bottom wall 34 is vertically adjustable to increase or decrease the size of the interior compartment 20. The size of the interior compartment 20 is inversely related to the size of the main compartment 18, such that, as the interior compartment 20 is increased in size, the adjustable bottom wall 34 of the interior compartment 20 is lowered, and, consequently, the size of the main compartment 18 is decreased as the adjustable bottom wall 34 is lowered. Further, as the interior compartment 20 is decreased in size, the adjustable bottom wall 34 of the interior compartment 20 is raised, and, consequently, the size of the main compartment 18 is increased as the adjustable bottom wall 34 is raised. Vertical movement of the adjustable bottom wall 34 is further described below.

Figure 3:
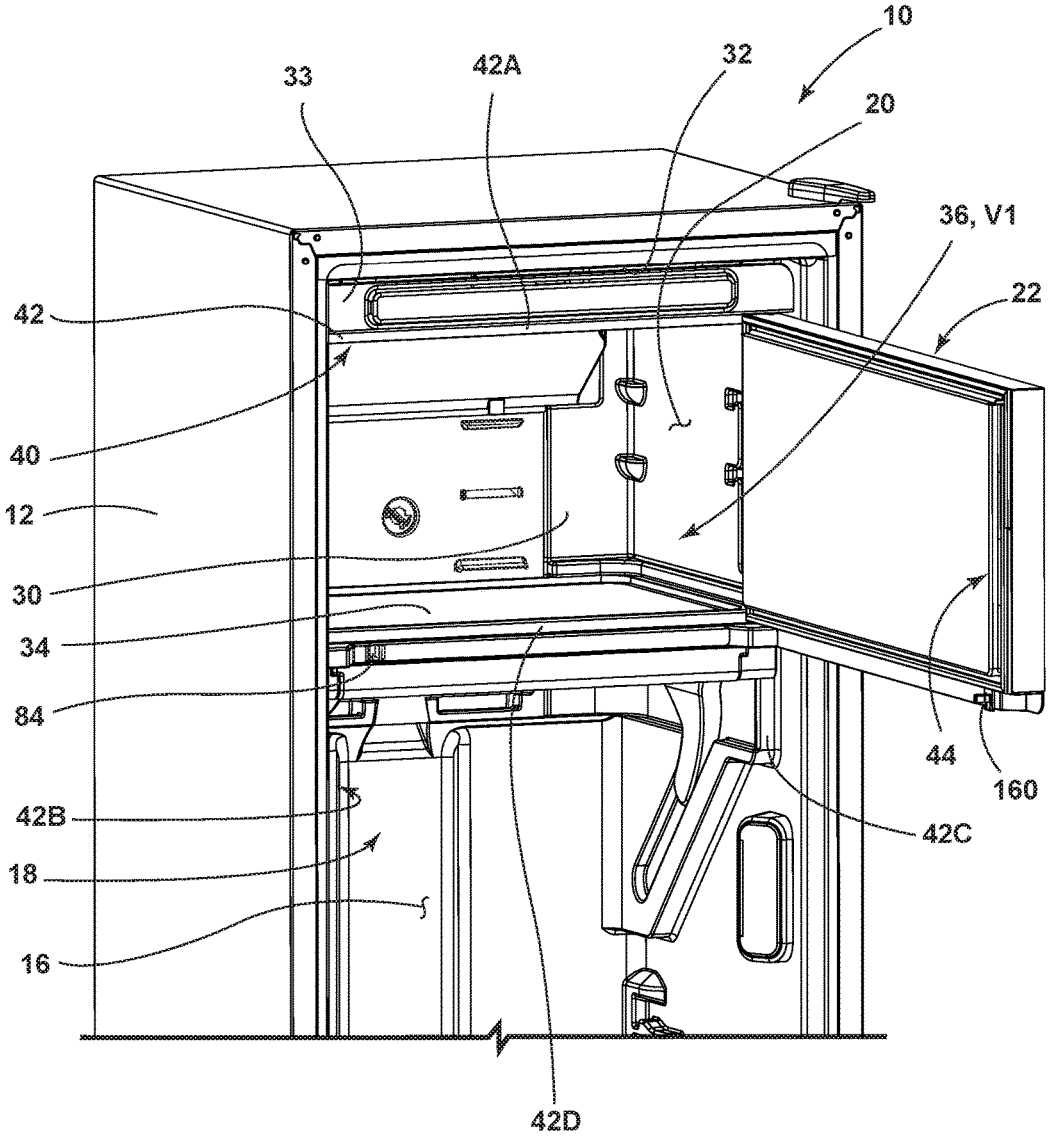
FIG. 3 is a partial top perspective view of the refrigerator of FIG. 2 with the inner door shown in an open position to reveal an interior compartment of the refrigerator with an adjustable bottom wall.

Referring now to FIG. 3, the door 22 is shown in an open position to reveal an interior space 36 of the interior compartment 20. The interior space 36 of the interior compartment 20 includes an interior volume that is adjustable in size between multiple volumetric settings. In FIG. 3, the interior volume of the interior compartment is in a first volumetric setting V1. The interior space 36 is substantially defined by a plurality of perimeter walls. The perimeter walls that cooperate to define the interior space 36 include the first and second sidewalls 26, 28 of the liner 24 that are spaced-apart and interconnected by the rear wall 30 of the liner 24. The first and second sidewalls 26, 28 of the liner 24 are also interconnected by the adjustable bottom wall 34 and the top wall 32 of the liner 24. Thus, the adjustable bottom wall 34 is an adjustable perimeter wall of the plurality of perimeter walls defining the interior space 36 of the interior compartment 20. The interior compartment 20 further includes an open front portion 40 with an outwardly facing sealing surface 42 disposed therearound. In use, the door 22 seals against the sealing surface 42 of the interior compartment 20 when the door 22 is in the closed position, as shown in FIG. 2. Thus, the door 22 is movably coupled to one or more of the perimeter walls of the interior compartment 20 near the open front portion 40 thereof between open and closed positions (FIGS. 2 and 3). Beyond a fixed pivoting coupling, the door 22 couples to the adjustable bottom wall 34 in a releasable manner when the door 22 is in the closed position at an engagement between a coupling feature in the form of a receiving aperture 84 disposed on the adjustable bottom wall 34, and a reciprocal coupling feature 160 disposed on the door 22, as further described below.

As further shown in FIG. 3, the door 22 includes a seal assembly 44, as further described below, which seals against the sealing surface 42 of the interior compartment 20 when the door 22 is in the closed position. The seal assembly 44 is configured to consistently seal against the entirety of the sealing surface 42 of the interior compartment 20 as the door 22 is extended and contracted in length with the adjustment of the interior space 36 of the interior compartment 20 using the adjustable bottom wall 34. Thus, the outwardly facing sealing surface 42 is comprised of a number of surfaces disposed on the perimeter walls of the interior compartment 20 and changes in size as the adjustable bottom wall 34 of the interior compartment 20 moves vertically within the storage compartment 16. In the embodiment shown in FIG. 3, the sealing surface 42 includes an upper section 42A disposed on a front rim portion 33 of the top wall 32. The sealing surface 42 further includes side sections 42B (not shown in FIG. 3) and 42C disposed on the first and second sidewalls 26, 28 of the liner 24. The sealing surface 42 further includes a lower section 42D disposed on the adjustable bottom wall 34 of the interior compartment 20. Together, the sections 42A-42D cooperate to define the outwardly facing sealing surface 42 of the interior compartment 20 which changes parameters as the interior space 36 of the interior compartment 20 moves between volumetric settings.

Figure 4:
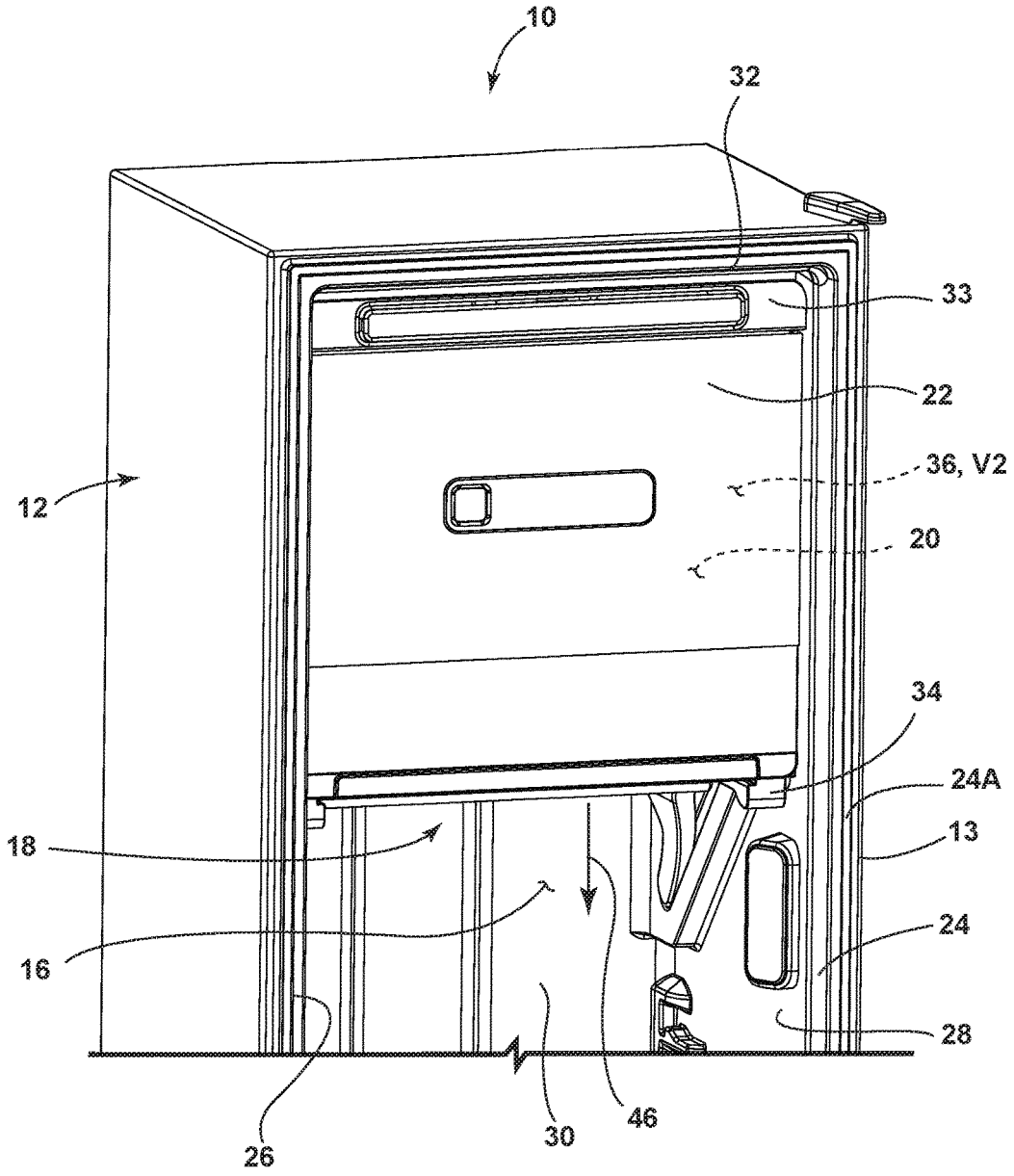
FIG. 4 is a partial top perspective view of the refrigerator of FIG. 2 with the adjustable bottom wall in a lowered position and the inner door in a closed and extended position.

Referring now to FIG. 4, the adjustable bottom wall 34 has been lowered in a direction as indicated by arrow 46 to increase the size or interior space 36 of the interior compartment 20. Thus, in FIG. 4, as compared to FIG. 3, the adjustable bottom wall 34 has been vertically lowered, such that the interior volume of the interior compartment 20 has increased from the first volumetric setting V1 of FIG. 3 to a second volumetric setting V2 of FIG. 4. The door 22 is shown in FIG. 4 in the extended position, relative to the retracted position of the door 22 shown in FIGS. 2 and 3.

Figure 5:
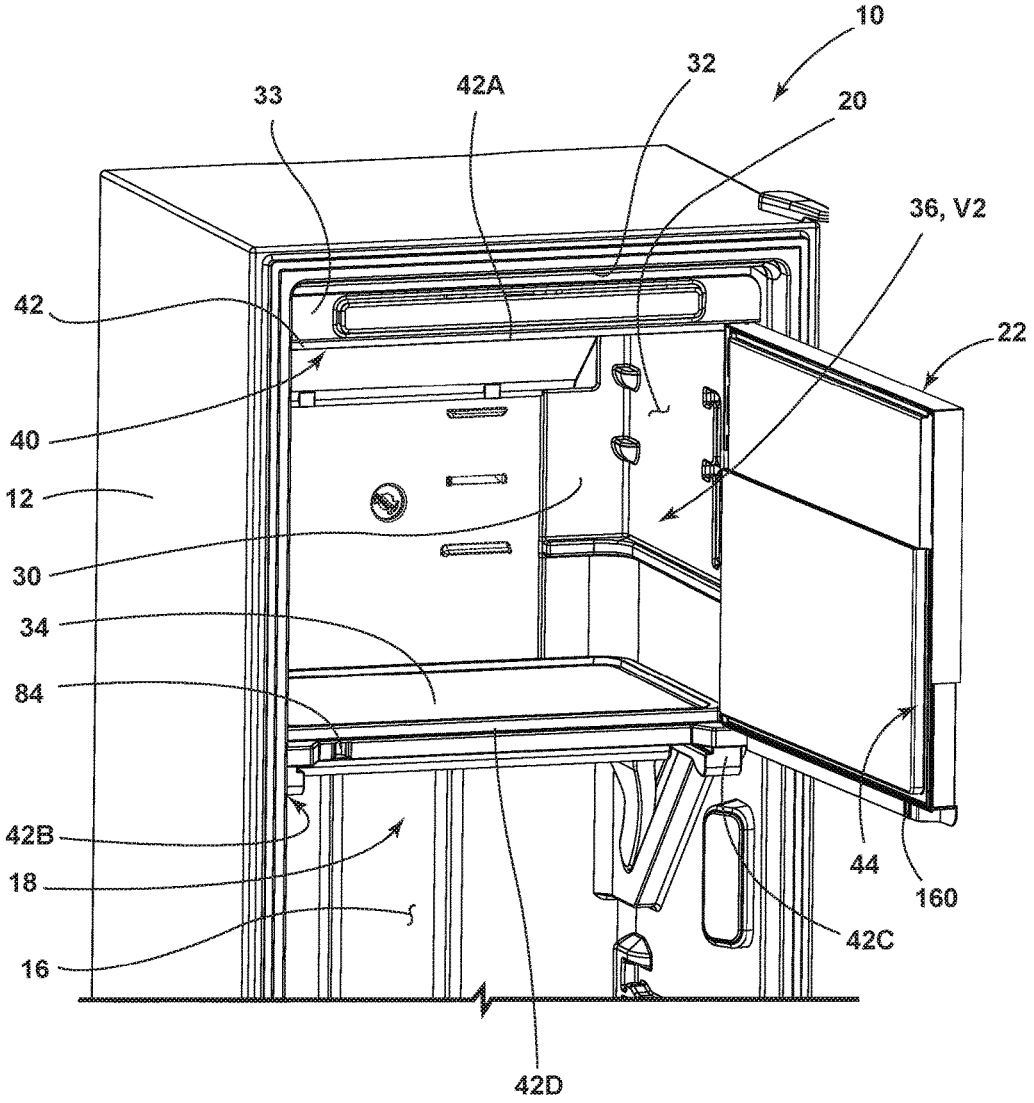
FIG. 5 is a partial top perspective view of the refrigerator of FIG. 4 with the inner door in an open position to reveal the interior compartment of the refrigerator in an expanded condition with the adjustable bottom wall in the lowered position.

Referring now to FIG. 5, the door 22 is shown in the open position with respect to the interior compartment 20, such that the increased interior space 36 of the interior compartment 20 is shown in second volumetric setting V2. It is contemplated that the door 22 moved to the extended position (as shown in FIGS. 4 and 5) from the retracted position (as shown in FIGS. 2 and 3) as the adjustable bottom wall 34 was vertically lowered within the storage compartment 16. The interconnection of the adjustable bottom wall 34 and the door 22 is further described below. With the adjustable bottom wall 34 lowered, the interior space 36 has increased from the first volumetric setting V1 (FIG. 3) to the second volumetric setting V2 (FIG. 5). It is further contemplated that the adjustable bottom wall 34 can move to other positions to provide for volumetric settings in between volumetric settings V1 and V2 for the interior compartment 20.

Figure 6:
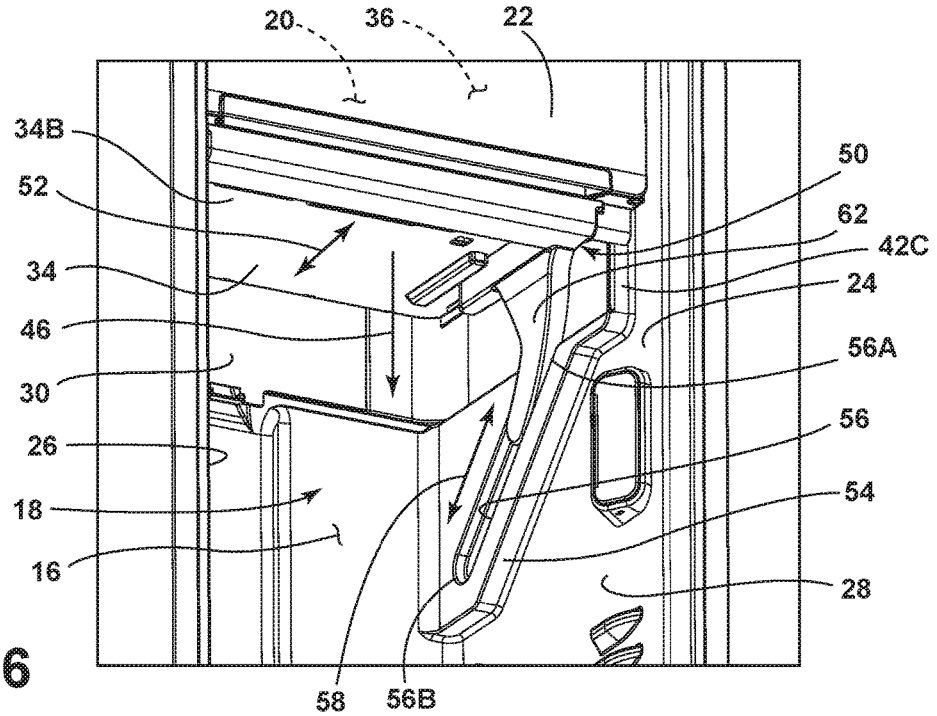
FIG. 6 is a partial bottom perspective view of the refrigerator of FIG. 2 showing the adjustable bottom wall in a raised position with the inner door in a retracted position.

Referring now to FIG. 6, the adjustable bottom wall 34 is shown in an uppermost or fully raised position, such that the interior space 36 of the interior compartment 20 is at its most reduced size. Slideably coupled to the adjustable bottom wall 34, an adjustment mechanism 50 is configured to adjust and retain the vertical position of the adjustable bottom wall 34. The adjustment mechanism 50 is slidably coupled to an underside 34B of the adjustable bottom wall 34 for fore and aft movement in the direction as indicated by arrow 52. The adjustment mechanism 50 is further slidably coupled to the liner 24 at both the first and second sidewalls 26, 28 thereof. As specifically shown in FIG. 6, the second sidewall 28 of the liner 24 includes an outwardly extending support portion 54 having a recessed inclined channel 56. The inclined channel 56 is disposed at a downward angle from a front portion 56A to a rear portion 56B thereof. While the inclined channel 56 is shown disposed in an outwardly extending support portion 54, it is further contemplated that the inclined channel 56 may be an integral part of the liner 24 that is recessed from the sidewall 28. In assembly, the inclined channel 56 is configured to receive a downwardly extending support guide 62 of the adjustment mechanism 50. The support guide 62 of the adjustment mechanism 50 moves along the inclined channel 56 of the liner 24 between upper and lower positions (FIGS. 6 and 7, respectively) from the front portion 56A to the rear portion 56B of the inclined channel 56. As the adjustment mechanism 50 moves towards the aft position in the direction as indicated by arrow 52, the adjustment mechanism 50 moves downward and the adjustable bottom wall 34, to which the adjustment mechanism 50 is mounted, is also drawn downward in the direction as indicated by arrow 46. Conversely, as the adjustment mechanism 50 moves towards the fore position in the direction as indicated by arrow 52, the adjustable bottom wall 34, to which the adjustment mechanism 50 is mounted, is moved upward. In this way, the movement of the support guide 62 of the adjustment mechanism 50 in the inclined channel 56 in the angled direction as indicated by arrow 58 causes the adjustable bottom wall 34 to move vertically within the storage compartment 16 along the path as indicated by arrow 46. Specific interaction between the adjustable bottom wall 34 and the adjustment mechanism 50 is further described below.

While a single support guide 62 is shown in FIG. 6 extending downwardly from the adjustment mechanism 50 to be received in the inclined channel 56 of the liner 24, it is contemplated that multiple support guides downwardly extend from the adjustment mechanism 50, such that the adjustment mechanism 50 is coupled to both the first and second sidewalls 26, 28 of the liner 24, as further described below. With support guides 60, 62 disposed at opposite sides of the adjustment mechanism 50 (as shown in FIGS. 8-9), balanced and consistent vertical movement of the adjustable bottom wall 34 is achieved.

Figure 7:
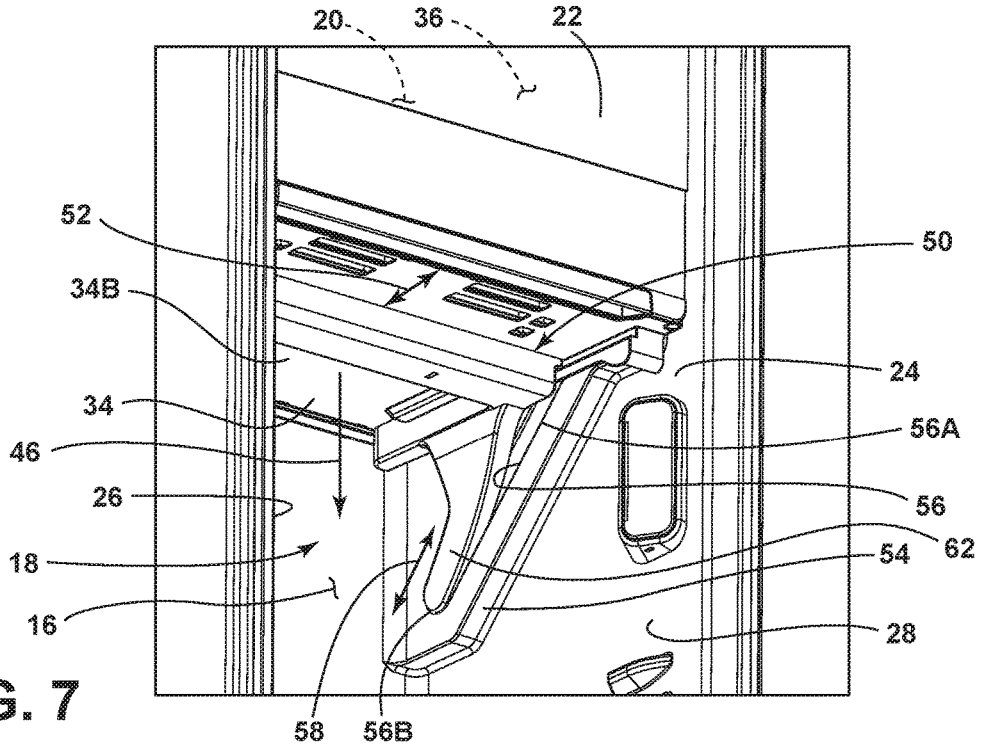
FIG. 7 is a partial bottom perspective view of the refrigerator of FIG. 4 showing the adjustable bottom wall in a lowered position with the inner door in an extended position.

Referring now of FIG. 7, the adjustable bottom wall 34 is shown in a lowered position relative to the raised position shown in FIG. 6. With the adjustable bottom wall 34 in the lowered position, the adjustment mechanism 50 has moved from the fore position shown in FIG. 6, to an aft position on the underside 34B of the adjustable bottom wall 34. In moving to the aft position, the support guide 62 of the adjustment mechanism 50 moves along inclined channel 56 from the front first portion 56A to the rear second portion 56B in the direction as indicated by the arrow 58. In so moving, the adjustment mechanism 50 draws the adjustable bottom wall 34 downward in the direction as indicated by arrow 46 to the lowered position shown in FIG. 7. As the adjustable bottom wall 34 moves to the fully lowered position shown in FIG. 7, the door 22 also moves from the retracted position (FIG. 6) to an extended position (FIG. 7). Thus, a portion of the door 22 moves with the adjustable bottom wall 34 between raised and lowered positions as the adjustable bottom wall 34, as coupled thereto, is adjusted by the adjustment mechanism 50 as further described below.

Figure 8:
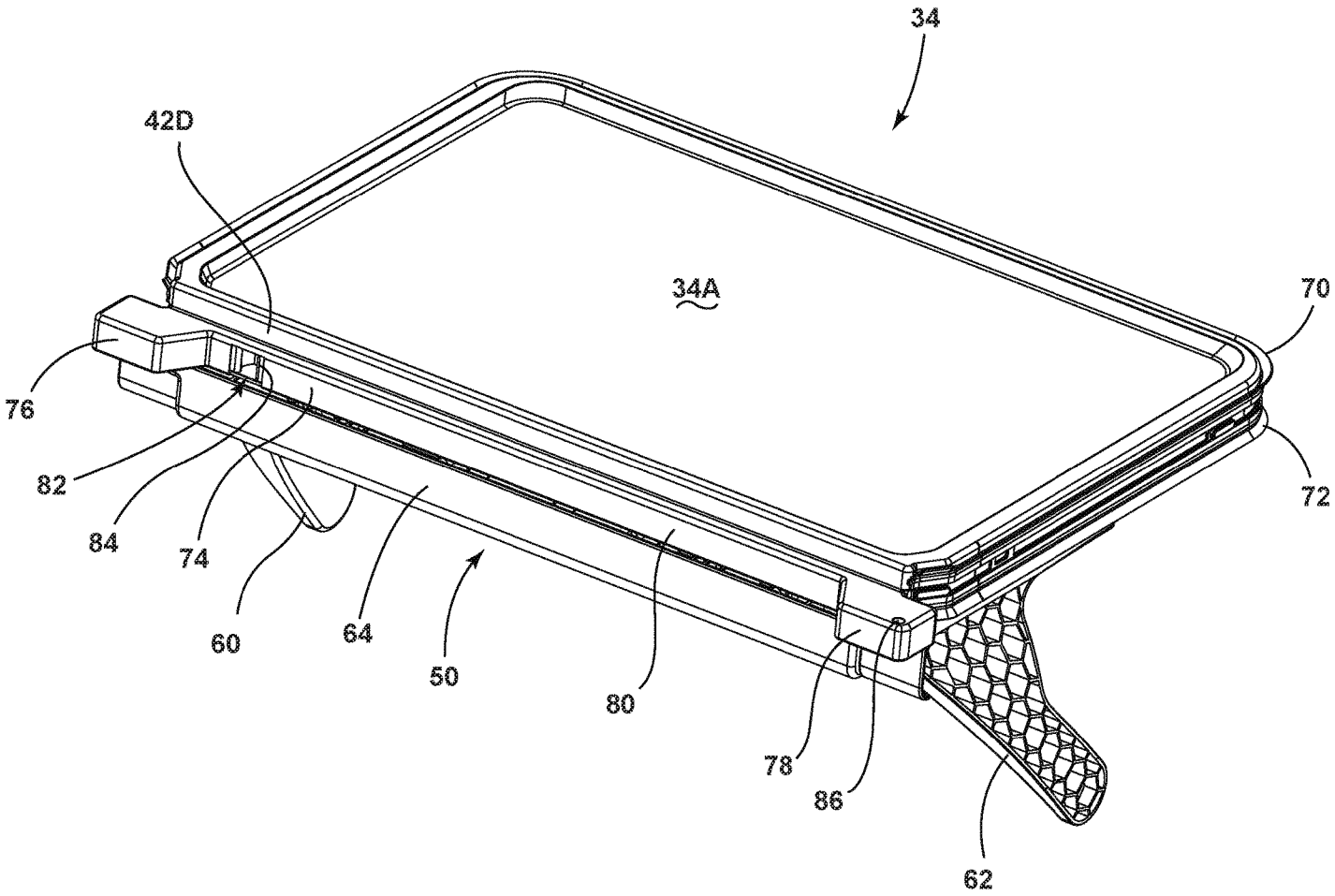
FIG. 8 is a top perspective view of an adjustable wall.

Referring now to FIG. 8, a top perspective view of the adjustable bottom wall 34 and adjustment mechanism 50 is shown, wherein the adjustable bottom wall 34 includes an upper support surface 34A. In use, the support surface 34A is configured to support various items stored within the interior compartment 20 of the refrigerator 10. As shown in FIG. 8, the adjustable bottom wall 34 includes upper and lower seals 70, 72 which outwardly extend around side and rear portions of the adjustable bottom wall 34. In assembly, the upper and lower seals 70, 72 are configured to seal against the sidewalls 26, 28 and rear wall 30 of the liner 24 as the adjustable bottom wall 34 moves vertically within the storage compartment 16. With the upper and lower seals 70, 72 in place, the adjustable bottom wall 34 can seal between the interior compartment 20 and the main compartment 18, such that different temperature settings can be maintained in the compartments 18, 20. It is contemplated that the upper and lower seals 70, 72 may be used individually on the adjustable bottom wall 34, or they may be used together, such that the adjustable bottom wall 34 may have one or more seals disposed therearound. Lower sealing surface section 42D is shown on a front portion of the adjustable bottom wall 34, and a coupling portion 74 is disposed below the lower sealing surface section 42D. The coupling portion 74 includes bolstered first and second ends 76, 78 having an inset middle portion 80 disposed therebetween. The inset middle portion 80 provides an outwardly facing surface for the adjustable bottom wall 34 having a coupling feature 82 disposed thereon. In the embodiment shown in FIG. 8, the coupling feature 82 includes a receiving aperture 84 extending inwardly into the adjustable bottom wall 34 from the outwardly facing surface of the inset middle portion 80 of the coupling portion 74. The second bolstered end 78 of the coupling portion 74 includes a receiving aperture 86 disposed therethrough which for pivotally coupling the door 22 to a first end of the adjustable bottom wall 34. In this way, the door 22 is mechanically affixed to the adjustable bottom wall 34, and can pivot with respect to the adjustable bottom wall 34 between open and closed positions. Coupling feature 82 is disposed on an opposite second end of the adjustable bottom wall 34 and is used to couple to a reciprocal coupling feature 160 (FIG. 3) of the door 22, such that the door 22 is coupled at opposite ends thereof to the coupling portion 74 of the adjustable bottom wall 34 at receiving apertures 84, 86 when the door 22 is in a closed position. As further shown in FIG. 8, the adjustment mechanism 50 includes a mounting portion 64 having first and second support guides 60, 62 extending downwardly therefrom on opposite ends thereof.

Figure 9:
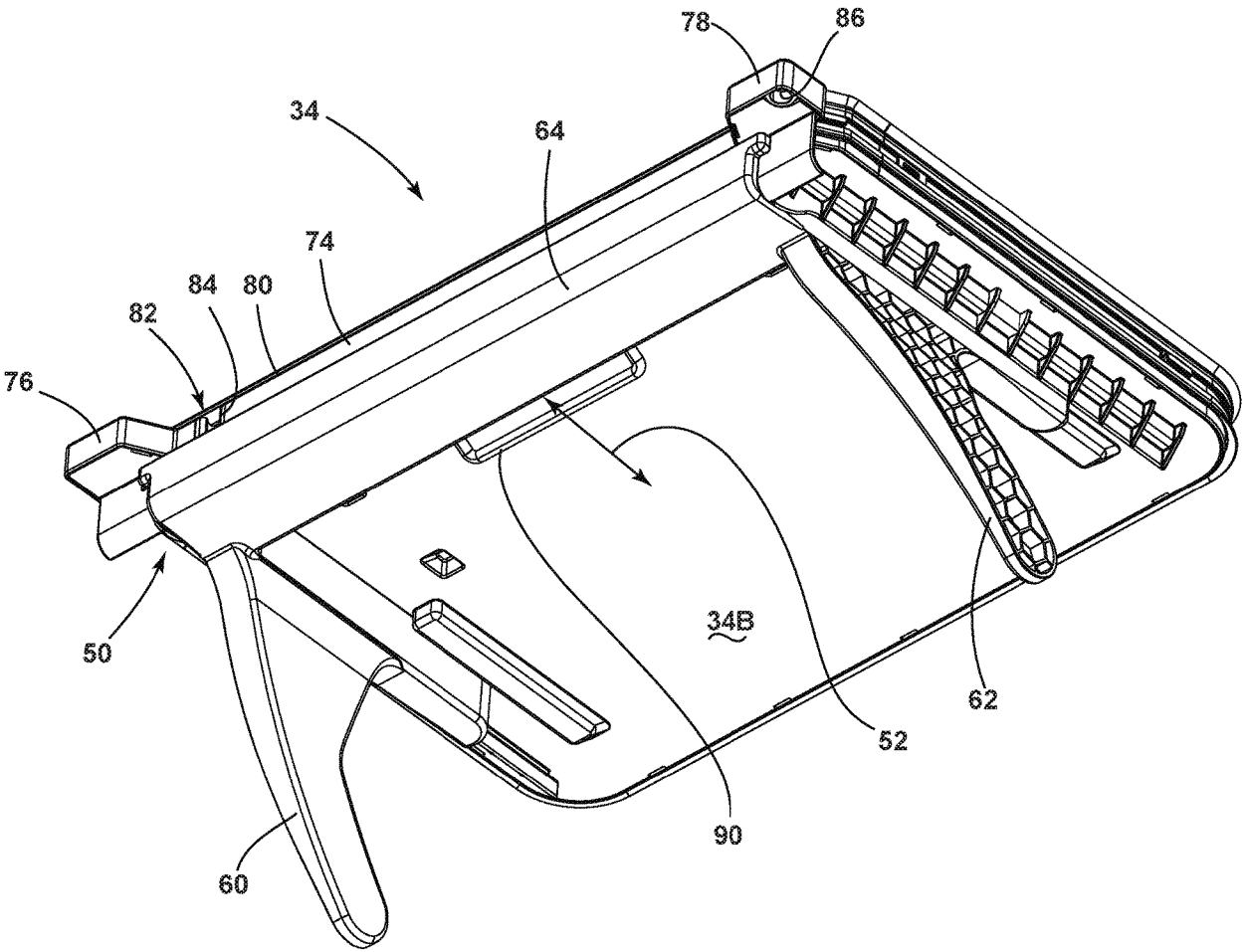
FIG. 9 is a bottom perspective view of the adjustable wall of FIG. 8.

Referring now to FIG. 9, the adjustable bottom wall 34 is shown from an underside thereof, wherein the mounting portion 64 of the adjustment mechanism 50 is shown having the first and second support guides 60, 62 downwardly extending in an angled manner from opposite sides of the mounting portion 64. As noted above, the adjustment mechanism 50 is slidably coupled to the underside 34B of the adjustable bottom wall 34 for movement in the direction as indicated by arrow 52 between fore and aft positions. In FIG. 9, the adjustment mechanism 50 is shown in the fore position on the underside 34B of the adjustable bottom wall 34. As further shown in FIG. 9, a retaining bar 90 is shown coupled to the mounting portion 64 of the adjustment mechanism 50 and is one type of retaining mechanism that can be used to engage and disengage the adjustment mechanism 50 with the underside 34B of the adjustable bottom wall 34.

Figure 10A:
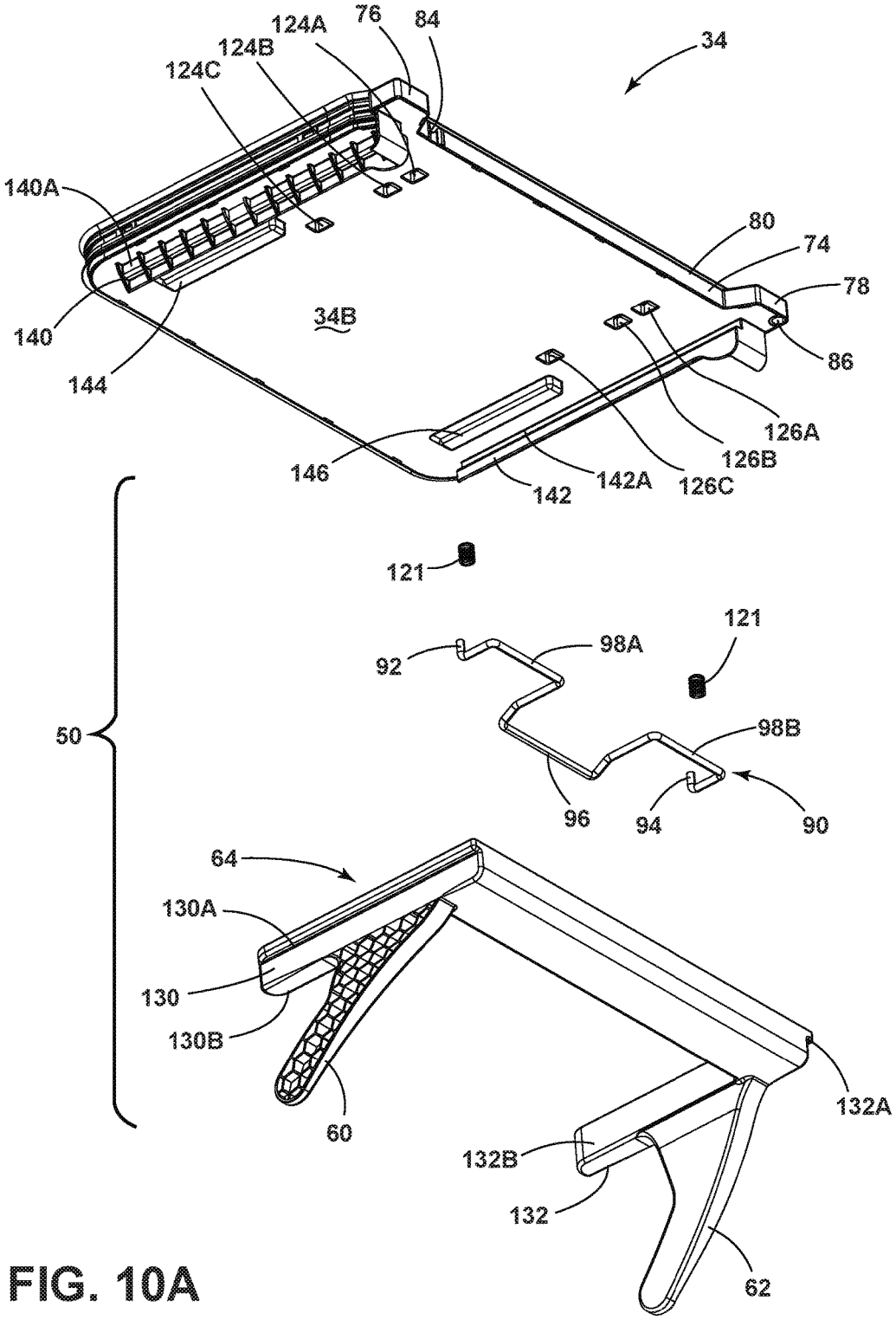
FIG. 10A is a bottom perspective view of the adjustable wall of FIG. 9 with an adjustment mechanism and retaining mechanism exploded away therefrom.

Referring now to FIG. 10A, the adjustment mechanism 50 is shown exploded away from the adjustable bottom wall 34. The retaining bar 90 is shown exploded away from the mounting portion 64 of the adjustment mechanism 50. As noted above, the retaining bar 90 is one contemplated option for retaining the adjustment mechanism 50 in the various horizontal portions along the underside 34B of the adjustable wall 34. As shown in FIG. 10A, the retaining bar 90 includes first and second ends 92, 94 which are upwardly extending with a handle portion 96 disposed therebetween. The retaining bar 90 further includes mounting portions 98A and 98B from which the retaining bar 90 is pivotally coupled to the mounting portion 64, as shown in phantom in FIG. 11A. Further, springs 121 define biasing mechanisms which are used to urge the first and second ends 92, 94 of the retaining bar 90 into engaged positions with the underside 34B of the adjustable bottom wall 34. The retaining bar 90 is operably coupled to the mounting portion 64 at mounting portions 98A, 98B such that the retaining bar 90 can pivot between engaged and disengaged positions relative to the underside 34B of the adjustable bottom wall 34.

Figure 11A:
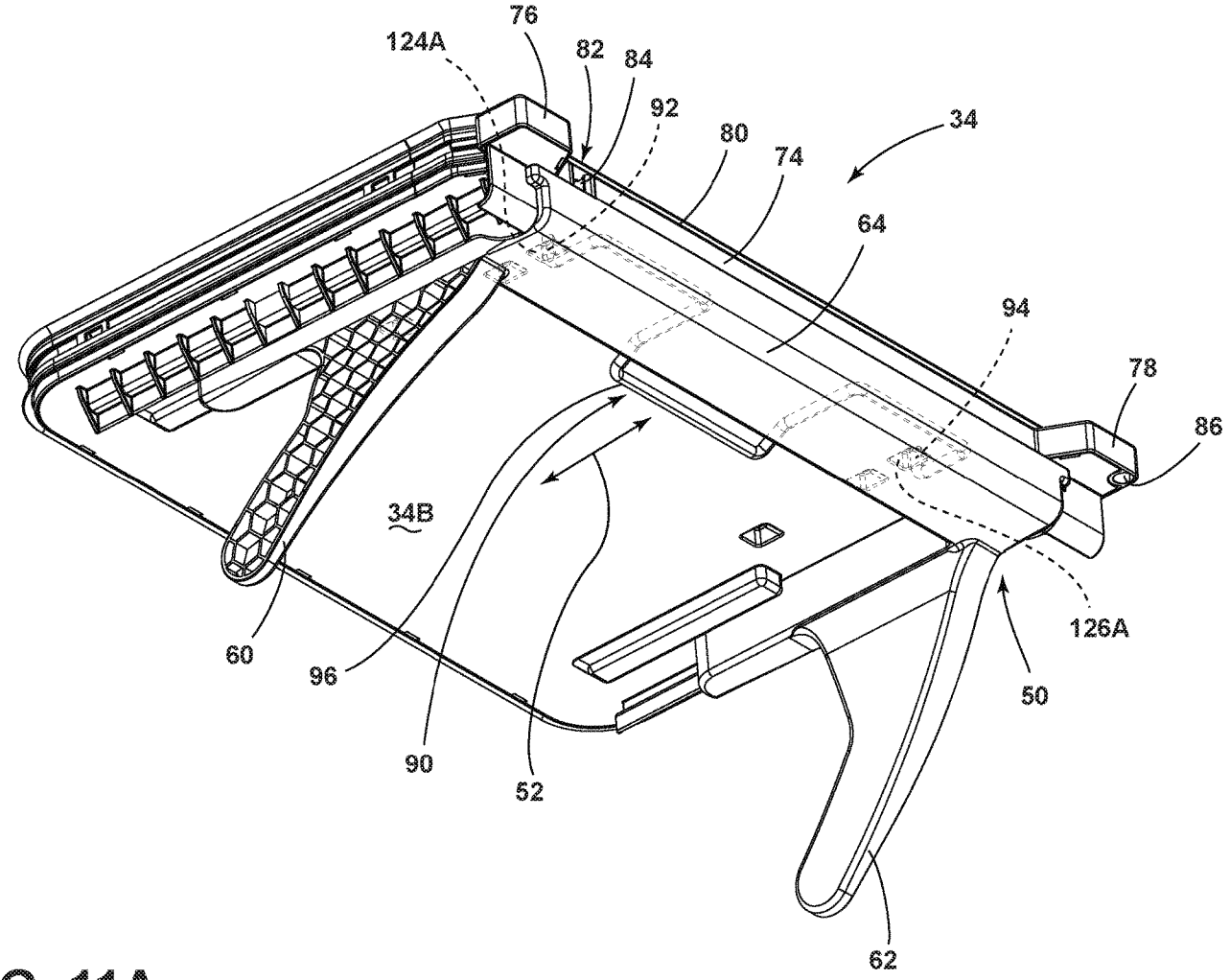
FIG. 11A is a bottom perspective view of the adjustable wall of FIG. 10A in an assembled condition with the retaining mechanism shown in phantom as coupled to the adjustment mechanism.

As further shown in FIG. 10A, the underside 34B of the adjustable bottom wall 34 includes rows of receiving apertures 124A-124C and 126A-126C. The receiving apertures, collectively referred to herein as receiving apertures 124, are configured to receive the upwardly extending first and second ends 92, 94 of the retaining bar 90 when the retaining bar 90 is in the engaged position, as shown in FIG. 11A. Specifically, when the retaining bar 90 is in the engaged position, the first and second ends 92, 94 of the retaining bar 90 are received in the receiving apertures 124A, 126A, respectively, when the adjustment mechanism 50 is in the fore position. In this way, the plurality of engagement features defined by receiving apertures 124 provide for pre-determined positions between fore, intermediate and aft positions for the fore and aft sliding movement of the adjustment mechanism 50. It is contemplated that more positions may be available for retaining the adjustment mechanism 50 in a variety of positions. The retaining bar 90 is used to retain the adjustment mechanism 50 in these predetermined positions. Again, as noted above, the fore and aft movement of the mounting portion 64 of the adjustment mechanism 50 provides for the first and second support guides 60, 62 being moved upwardly and downwardly along the inclined channels 56 of the sidewalls 26, 28 of the refrigerator cabinet 12, such that the adjustment mechanism 50 draws the adjustable bottom wall 34 vertically downward as the support guides 60, 62 move vertically downward in the angled direction as indicated by arrow 58 in FIG. 6.

In moving the adjustment mechanism 50 from the fore position (FIG. 6) to the aft position (FIG. 7), the retaining bar 90 is pivoted to the disengaged position, such that the first and second ends 92, 94 of the retaining bar 90 are released from the receiving apertures 124A, 126A. Once the retaining bar 90 is disengaged from the receiving apertures 124A, 126A, the adjustment mechanism 50 can be moved towards the receiving apertures 124C, 126C to move the adjustment mechanism 50 to the aft position (FIG. 7). When the retaining bar 90 is released with the first and second ends 92, 94 of the retaining bar 90 aligned with the receiving apertures 124A, 126A, the biasing mechanisms 121 will urge the retaining bar 90 towards the engaged position, such that the first and second ends 92, 94 will be received in the receiving apertures 124A, 126A to retain the adjustment mechanism 50 in the aft position. Thus, the first and second ends 92, 94 of the retaining bar 90 are reciprocal engagement features to the engagement features (the receiving apertures 124A-124C, 126A-126C) of the adjustable bottom wall 34.

Figure 10B:
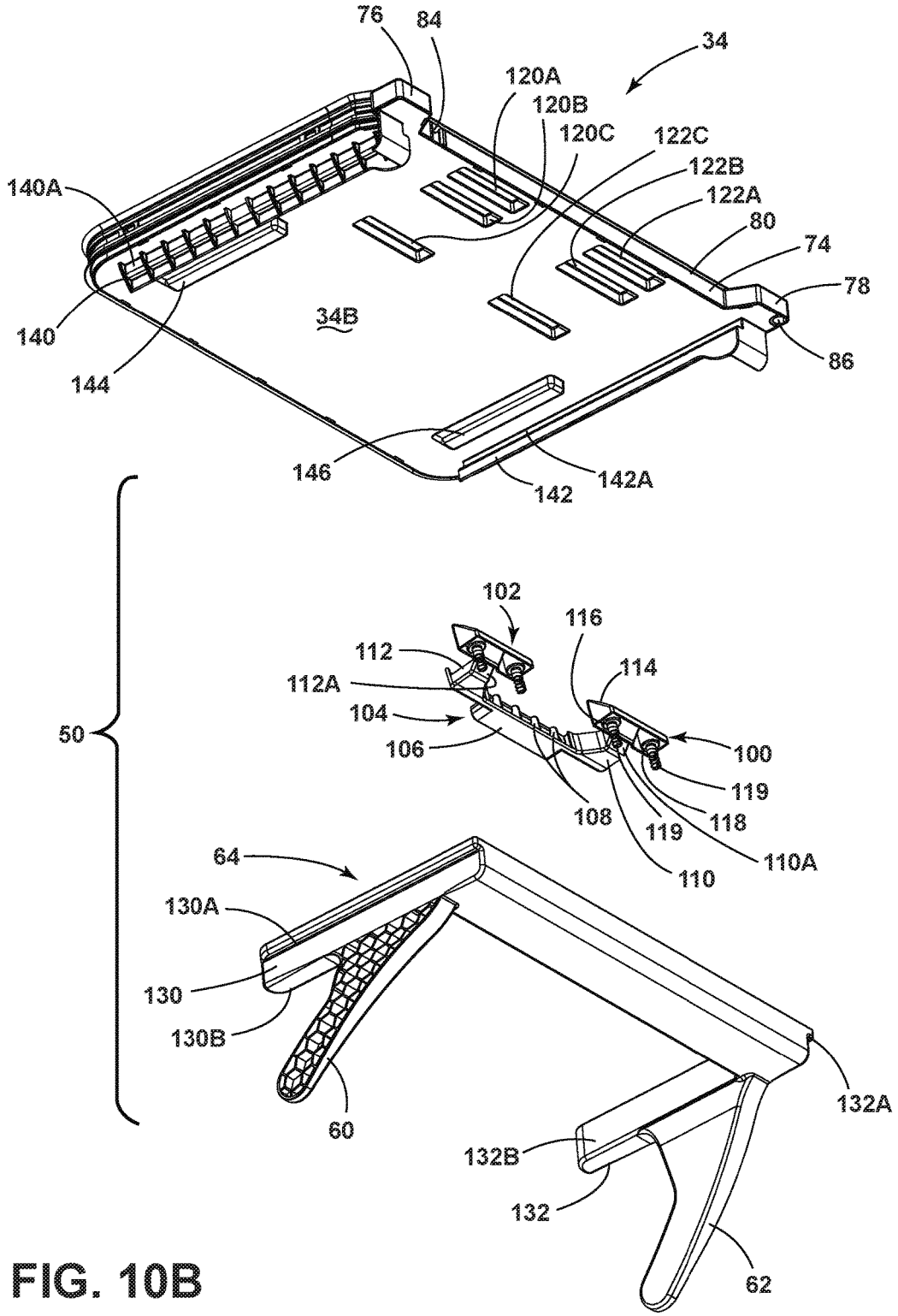
FIG. 10B is a bottom perspective view of the adjustable wall of FIG. 10A with the adjustment mechanism and another embodiment of a retaining mechanism exploded away therefrom.

Referring now to FIG. 10B, another retaining mechanism is shown. In the embodiment of FIG. 10B, first and second retaining blocks 100, 102 are configured to be selectively engaged by a sliding bracket 104 to define another type of retaining mechanism for the adjustable bottom wall 34. The sliding bracket 104 includes a handle portion 106 with reinforcement members 108 disposed thereon. The sliding bracket 104 further includes first and second legs 110, 112 which include inclined surfaces 110A, 112A, respectively. The inclined surfaces 110A, 112A are used to engage and urge the retaining blocks 100, 102, respectively, out of engagement with the underside 34B of the adjustable bottom wall 34. With reference to retaining block 100, each retaining block 100, 102 includes an inclined forward-facing engagement surface 114 that acts as a ramped introductory portion of the retaining block 100 for the receiving of the retaining block 100 in one or more retaining slots disposed on the underside 34B of the adjustable bottom wall 34. The retaining blocks 100, 102 further include mounting bosses 116, 118 from which biasing mechanisms 119 (in the form of springs) are mounted for further coupling to the mounting portion 64 of the adjustment mechanism 50. In this way, the springs 119 bias the retaining blocks 100, 102 towards engaged positions with the retaining slots of the adjustable bottom wall 34. The retaining blocks 100, 102 may be referred to herein as coupling features or engagement features that are used to couple the mounting portion 64 an retain the mounting portion 64 in a horizontal position along underside 34B of the adjustable bottom wall 34.

Figure 11B:
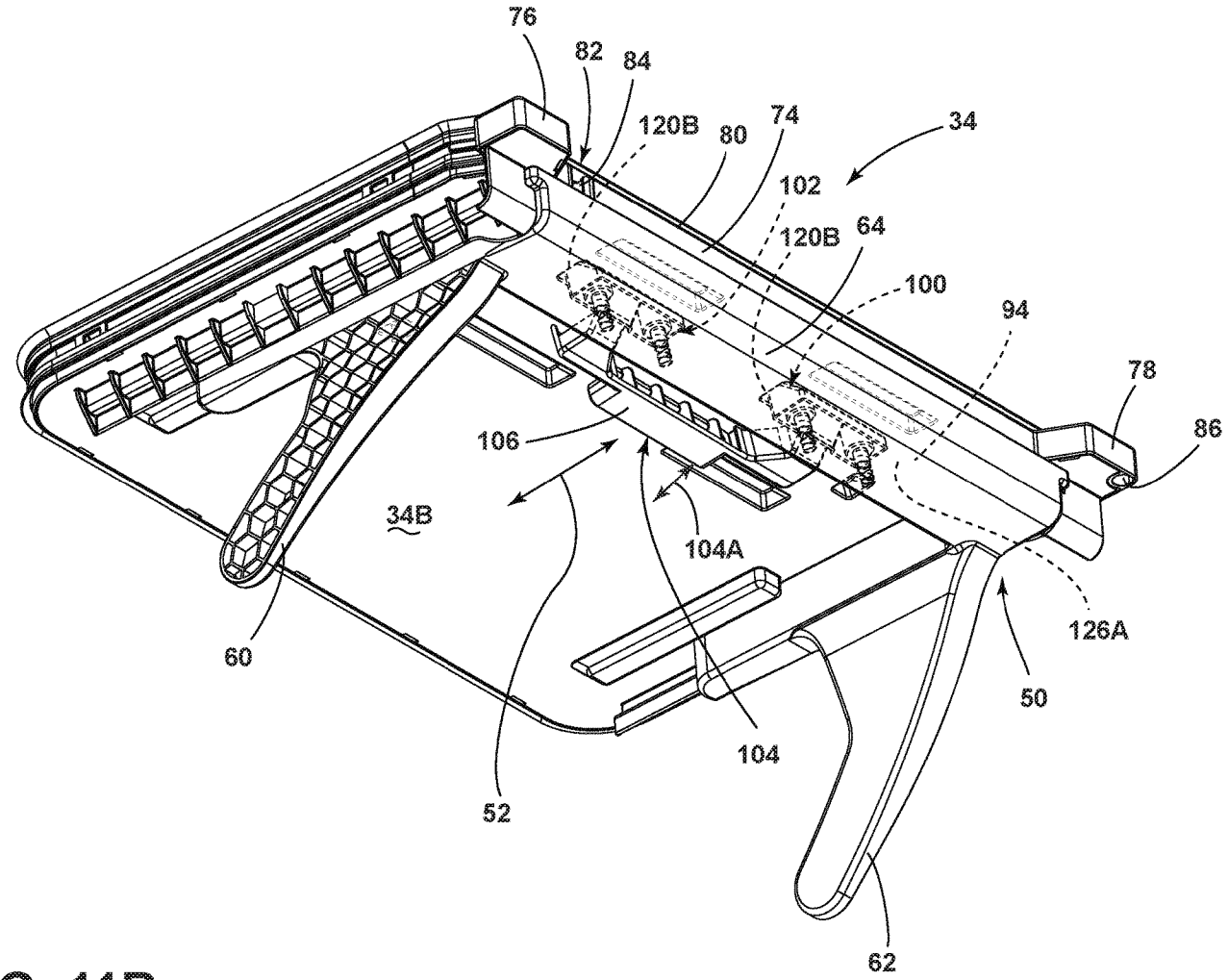
FIG. 11B is a bottom perspective view of the adjustable wall of FIG. 10B in an assembled condition with the retaining mechanism shown in phantom as coupled to the adjustment mechanism.

Lateral movement of the sliding bracket 104 along the path as indicated by arrow 104A (FIG. 11B) between first and second positions results in the moving of the retaining blocks 100, 102 between engaged and disengaged positions with a plurality of retaining slots disposed on the underside 34B of the adjustable bottom wall 34. In FIG. 10B, the retaining slots are shown as retaining slots 120A through 120C which are paired with retaining slots 122A through 122C. In this way, the retaining slots, collectively referred to herein as retaining slots 120, are set at predetermined locations along the fore and aft path of the adjustment mechanism 50 along the underside 34B of the adjustable bottom wall 34. Specifically, retaining slots 120A, 122A define a forward set of engagement features for receiving the retaining blocks 100, 102 of the adjustment mechanism 50. When retaining blocks 100, 102 are received in retaining slots 120A, 122A, the adjustment mechanism 50 is disposed in the fore position as shown in FIGS. 6 and 11B. With the adjustment mechanism 50 in the fore position, the adjustable bottom wall 34 is contemplated to be in the raised position as shown in FIG. 6. In moving the adjustment mechanism 50 from the fore position (FIG. 6) to the aft position (FIG. 7), the sliding bracket 104 is pulled towards the mounting portion 64 of the adjustment mechanism 50 by a user from the at-rest (or first) position to the disengaging (or second) position. In the second position, the sliding bracket 104 has moved the retaining blocks 100, 102 to the disengaged position from the engaged position, such that the retaining blocks 100, 102 are released from the retaining slots 120A, 122A. With the retaining blocks 100, 102 in the disengaged position, the adjustment mechanism 50 can be moved rearward towards the retaining slots 120C, 122C. When the sliding bracket 104 is released with the retaining blocks 100, 102 aligned with retaining slots 120C, 122C, the biasing mechanisms 119 will urge the retaining blocks 100, 102 towards the engaged position, such that the retaining blocks 100, 102 will be received in the retaining slots 120C, 122C to retain the adjustment mechanism 50 in the aft position, and the sliding bracket will revert to the first position by a wedged interaction between the retaining blocks 100, 102 and the inclined surfaces 110A, 112A of the sliding bracket 104, respectively. The inclined forward-facing engagement surfaces 114 of the retaining blocks 100, 102 helps with the entry of the retaining blocks 100, 102 into the retaining slots 120 of the underside 34B of the adjustable bottom wall 34. The retaining slots 120C, 122C define a rearward set of engagement features on the underside 34B of the adjustable bottom wall 34. An intermediate set of engagement features is defined by retaining slots 120B, 122B which is disposed between the forward and rearward set of retaining slots (120A, 122A and 120C, 122C) on the underside 34B of the adjustable bottom wall 34 to retain the adjustment mechanism 50 in an intermediate position between the fore and aft positions. It is contemplated that any number of intermediate retaining slots can be disposed between the forward and rearward set of retaining slots (120A, 122A and 120C, 122C) to provide for multiple intermediate positions of the adjustment mechanism 50 and the adjustable bottom wall 34. The retaining slots 120 may be referred to herein as engagement features or coupling features used to engage or couple to the coupling features and engagement features of the mounting portion 64, such as the retaining blocks 100, 102. Thus, the first and second retaining blocks 100, 102 are reciprocal engagement features to the engagement features (the receiving slots 120A-120C, 122A-122C) of the adjustable bottom wall 34.

As further shown in FIGS. 10A and 10B, the mounting portion 64 includes first and second rearwardly extending legs 130, 132 from which the support guides 60, 62 downwardly extend. The rearwardly extending legs 130, 132 include outwardly extending flange portions 130A, 132A, respectively, for coupling the mounting portion 64 in a sliding manner to the underside 34B of the adjustable bottom wall 34. The adjustable bottom wall 34 further includes downwardly extending brackets 140, 142 having inset portions 140A, 142A, respectively. In assembly, the outwardly extending flange portions 130A, 132A of the first and second rearwardly extending legs 130, 132 of the mounting portion 64 are received in the inset portions 140A, 142A, respectively, of the downwardly extending brackets 140, 142. Downwardly extending retaining members 144, 146 provide an abutment feature for retaining the first and second legs 130, 132 in engaged positions with the brackets 140, 142 by abutting inner surfaces 130B, 132B of the first and second legs 130, 132, respectively. In this way, the sliding motion of the adjustment mechanism 50 is guided for consistent movement of the adjustment mechanism 50 between fore and aft positions along the underside 34B of the adjustable bottom wall 34.

Figure 12A:
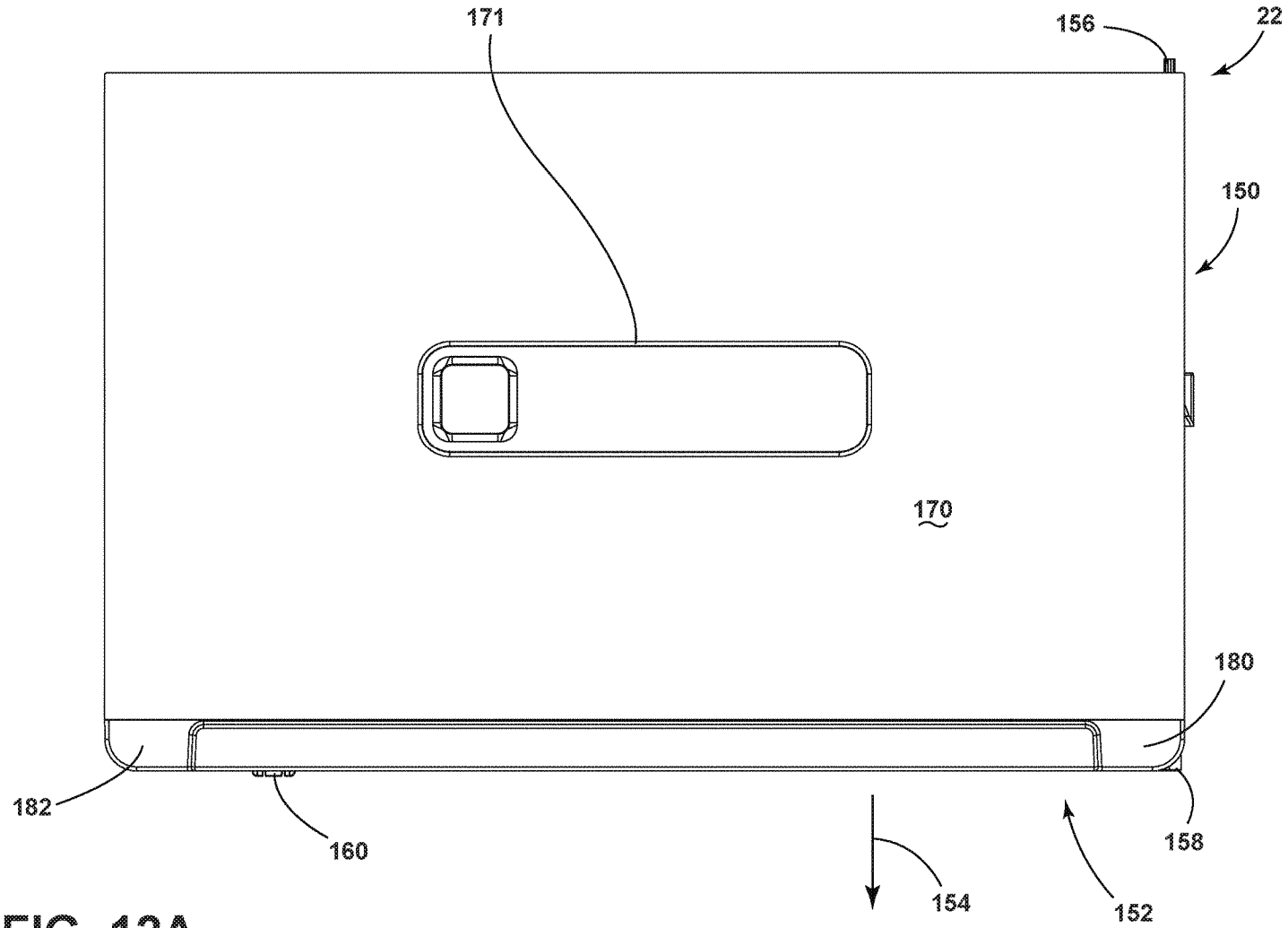
FIG. 12A is a front elevational view of the door in a retracted position.

Referring now to FIG. 12A, the door 22 is shown removed from the refrigerator 10 (FIG. 2). The door 22 includes a first member 150, and a second member 152. The first member 150 may be referred to herein as a fixed member as the first member 150 pivots between open and closed positions with respect to the interior compartment 20, however, the first member 150 is contemplated to remain in a fixed vertical location even as the interior compartment 20 expands and contracts. The second member 152 may be referred to herein as a moving member in that the second member 152 is configured to move vertically in the direction as indicated by arrow 154 between extended and retracted positions. It is also contemplated that both the first member 150 and the second member 152 can move vertically to increase the overall size of the door 22. In the embodiment shown in FIG. 12A, the second member 152 is shown in the retracted position relative to the first member 150. In this position, the door 22 is configured to open and close the interior compartment 20 when the adjustable bottom wall 34 of the interior compartment 20 is in the fully raised position, as shown in FIG. 3, to provide a compact sized interior compartment 20. As further shown in FIG. 12A, the door 22 includes an upwardly extending attachment post 156 which is used to couple the door 22 in a pivoting manner to the front rim portion 33 disposed on the top wall 32 of the refrigerator 10, as shown in FIG. 3. The attachment post 156 extends upwardly from an upper portion the first member 150. Extending downwardly from a lower portion of the second member 152, a fastener 158 is used to couple the door 22 to the receiving aperture 86 disposed through the bolstered end 78 of the forward facing surface of the inset middle portion 80 of the adjustable bottom wall 34, as shown in FIG. 9. The second member 152 further includes a coupling feature 160 that is used to releasably couple to the receiving aperture 84 disposed on the forward facing surface of the inset middle portion 80 of the adjustable bottom wall 34, as shown in FIG. 8, as the door 22 moves between open and closed positions. As further shown in FIG. 12A, the first member 150 includes an exterior surface 170, which, in the embodiment of FIG. 12A, includes a plate 171 disposed in a central portion thereof which may display an indicia of the refrigerator 10, such as the manufacturers name or the like. The second member 152 includes a base portion 180 having an exterior surface 182 which makes up a portion of an overall exterior surface of the second member 152.

Figure 12B:
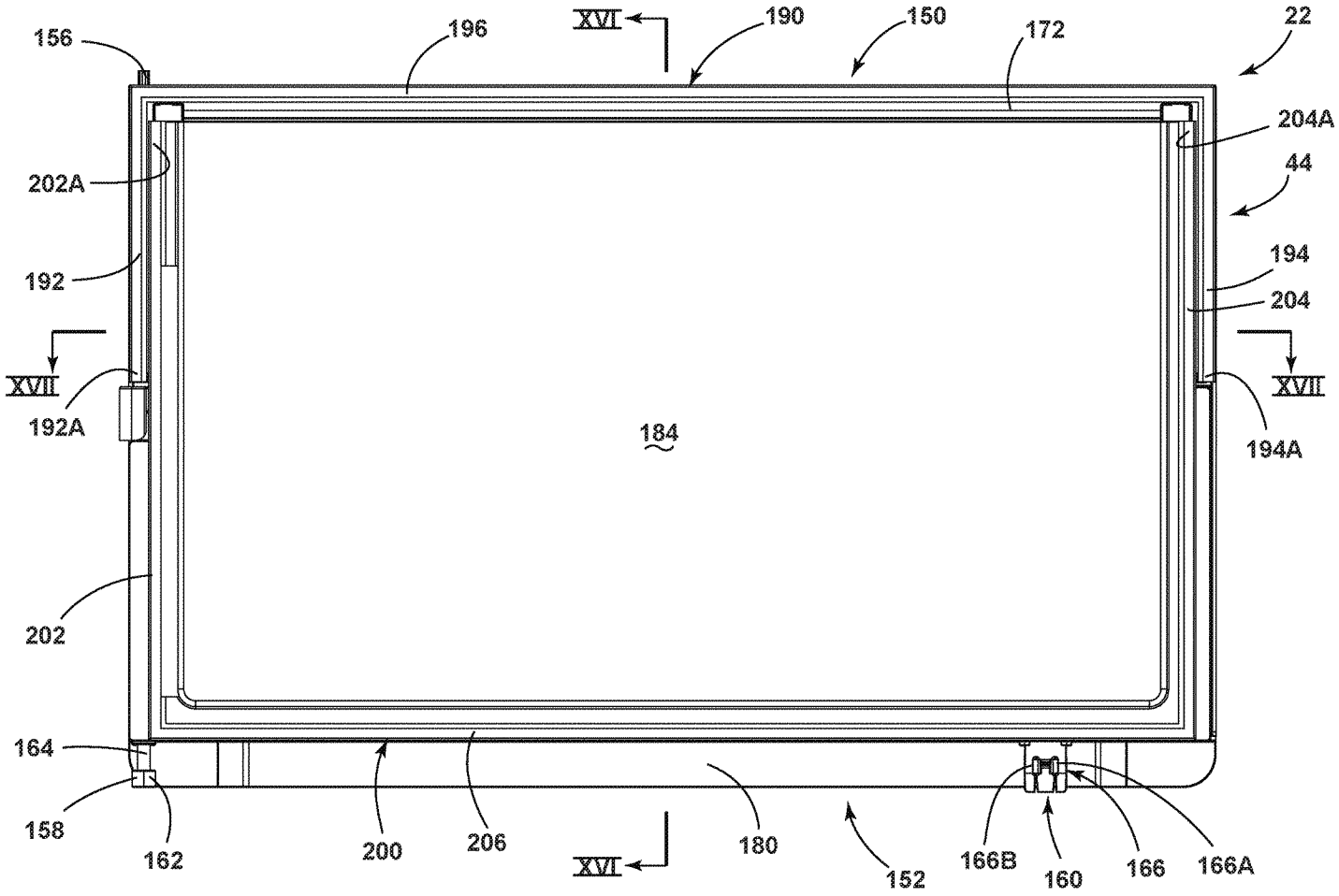
FIG. 12B is a rear elevational view of the door of FIG. 12A in the retracted position.

Referring now to FIG. 12B, the door 22 is shown from an inside view, wherein an inner surface 184 of the second member 152 is shown. The fastener 158 is shown downwardly extending from the second member 152 and having a head portion 162 and a stem portion 164 for mechanically coupling the door 22 to the receiving aperture 86 of the adjustable bottom wall 34. The coupling feature 160 is shown in FIG. 12B in the form of a flexibly resilient clip member 166 having flexibly resilient arms 166A, 166B for coupling to the receiving aperture 84 disposed on the adjustable bottom wall 34. From the inner view of the door 22, the seal assembly 44 of the door 22 can be seen. The seal assembly 44 of the door 22 includes a first seal member 190 disposed on the first member 150 at an upper and outer perimeter thereof. The first seal member 190 includes first and second ends 192, 194 which downwardly extend from an intermediate portion 196 which interconnects the first and second ends 192, 194. As shown in FIG. 12B, the first seal member 190 is disposed in an inverted U-shape with the first and second end portions 192, 194 downwardly extending from the intermediate portion 196. The first seal member 190 is disposed on an inner surface 172 of the first member 150 and outwardly extends therefrom. Thus, in assembly, the first seal member 190 outwardly extends from the door 22 towards the sealing surface 42 of the interior compartment 20. Specifically, the intermediate portion 196 outwardly extends to seal against the upper section 42A of the sealing surface 42 as shown in FIG. 3. The first and second end portions 192, 194 outwardly extend from the inner surface 172 of the first member 150 to seal against the side sections 42B, 42C of the front sealing surface 42, respectively, as shown in FIG. 3. As further shown in FIG. 12B the second member 152 includes a second seal member 200 which outwardly extends from the inner surface 184 of the second member 152. The second seal member 200 is shown in a U-shaped configuration having first and second end portions 202, 204 which upwardly extend from an intermediate portion 206. As shown in FIG. 12B, the first and second end portions 202, 204 of the second seal member 200 are inset from the first and second end portions 192, 194 of the first seal member 190, such that the upper portions 202A, 204A of the first and second end portions 202, 204 of the second seal member 200 overlap with the lower portions 192A, 194A of the first and second end portions 192, 194 of the first seal member 190. In this way, the seal assembly 44 provides first and second seal members 190, 200 which cooperate to fully seal against a perimeter of the door 22 at the sealing surface 42 of the interior compartment 20.

Figure 13A:
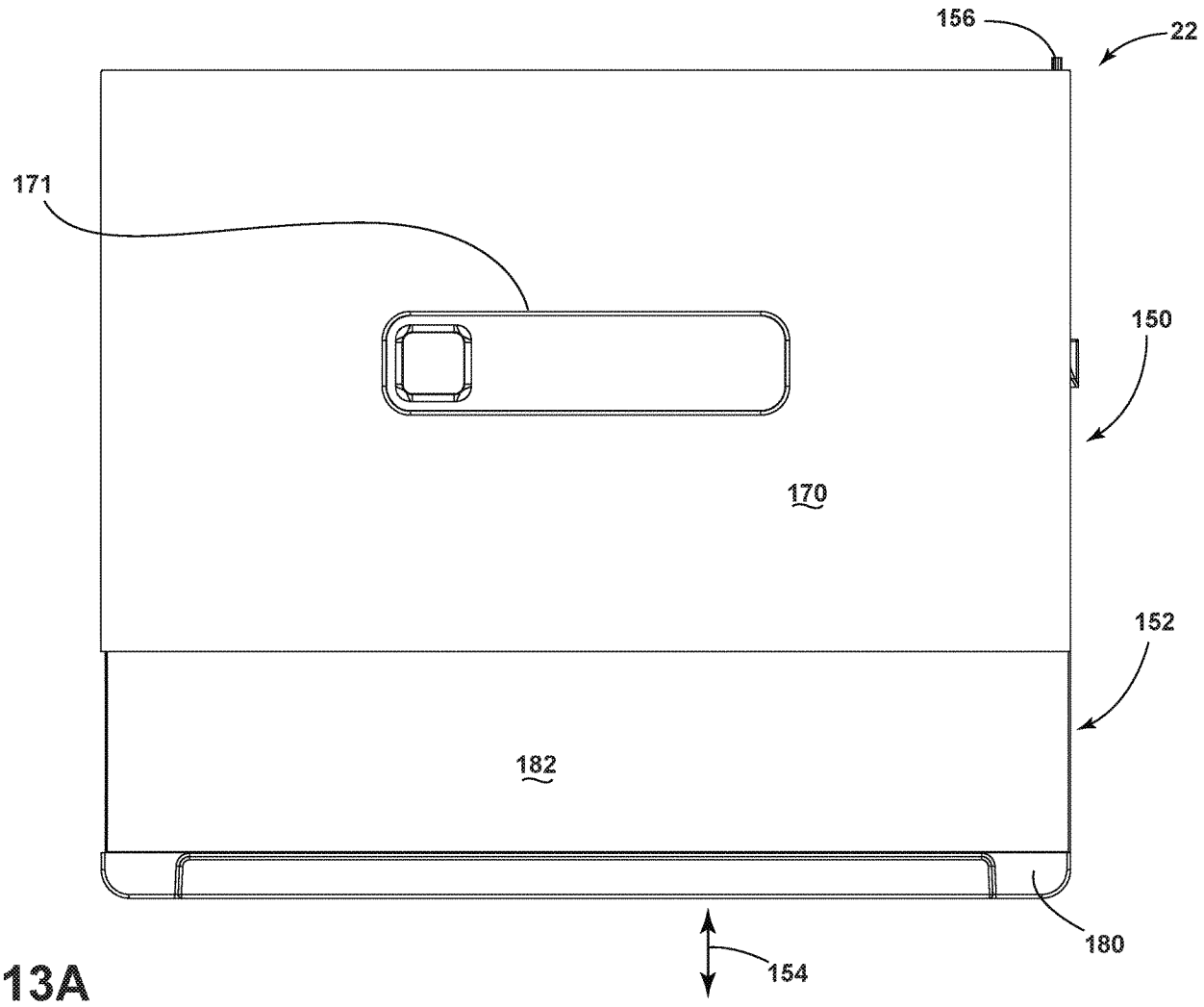
FIG. 13A is a front elevational view of the door in an extended position.
Figure 13B:
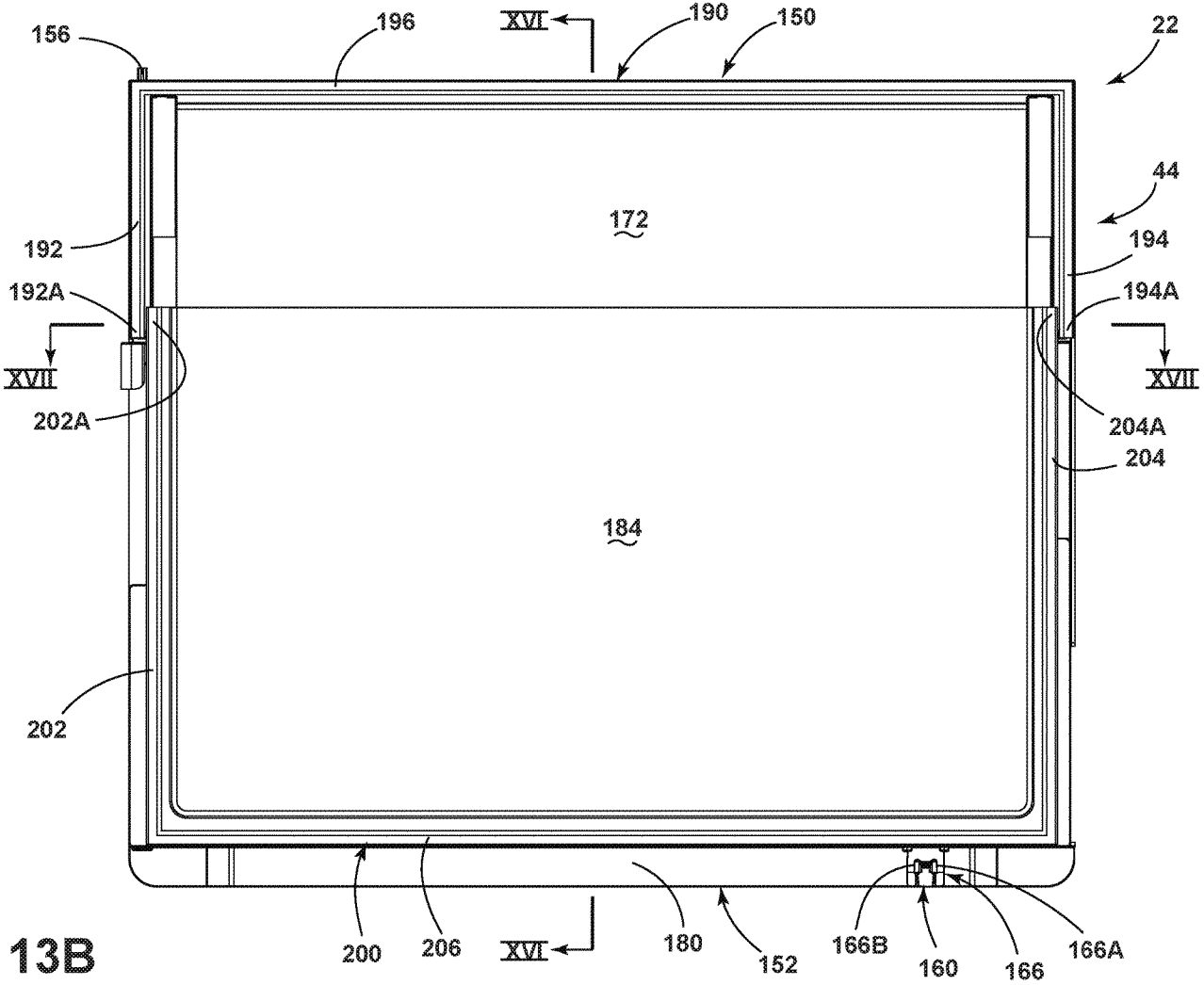
FIG. 13B is a rear elevational view of the door of FIG. 13A in the extended position.

Referring now to FIG. 13A, the door 22 is shown from a front plan view, wherein the second member 152 is shown in an extended position relative to the first member 150. In the extended position, the second member 152 reveals an exterior surface 182 which is positioned behind the exterior surface 170 of the first member 150 when the second member 152 is in the retracted position, as shown in FIG. 12A. Thus, in FIG. 13A, the second member 152 has moved from the retracted position (FIG. 12A) to the extended position to increase the overall length of the door 22. With the door 22 in the expanded or extended position, the door 22 can fully cover the open front portion 40 of the interior compartment 20 when the adjustable bottom wall 34 is in the lower position to expand the size of the interior compartment 20 and the open front portion 40, as shown in FIG. 5. Further, the door 22 is configured to fully seal against the sealing surface 42 of the interior compartment 20 when the door 22 is in the extended position as further described below with reference to FIG. 13B.

Referring now to FIG. 13B, the door 22 is again shown in the extended position and the seal assembly 44 is shown with the second seal member 200 moved vertically downward from the raised position shown in FIG. 12B. While the second seal member 200 has moved downward with the second member 152, it is important to note that the upper ends 202A, 204A of the first and second end portions 202, 204 of the second seal member 200 are still disposed adjacent to and inset from the lower ends 192A, 194A of the first and second end portions 192, 194 of the first seal member 190. In this way, the first and second seal members 190, 200 are overlapping on both sides of the door 22 to provide a continuous seal around the perimeter of the door 22 for sealing against the sealing surface 42 of the interior compartment 20 when the door 22 is fully extended.

Figure 14:
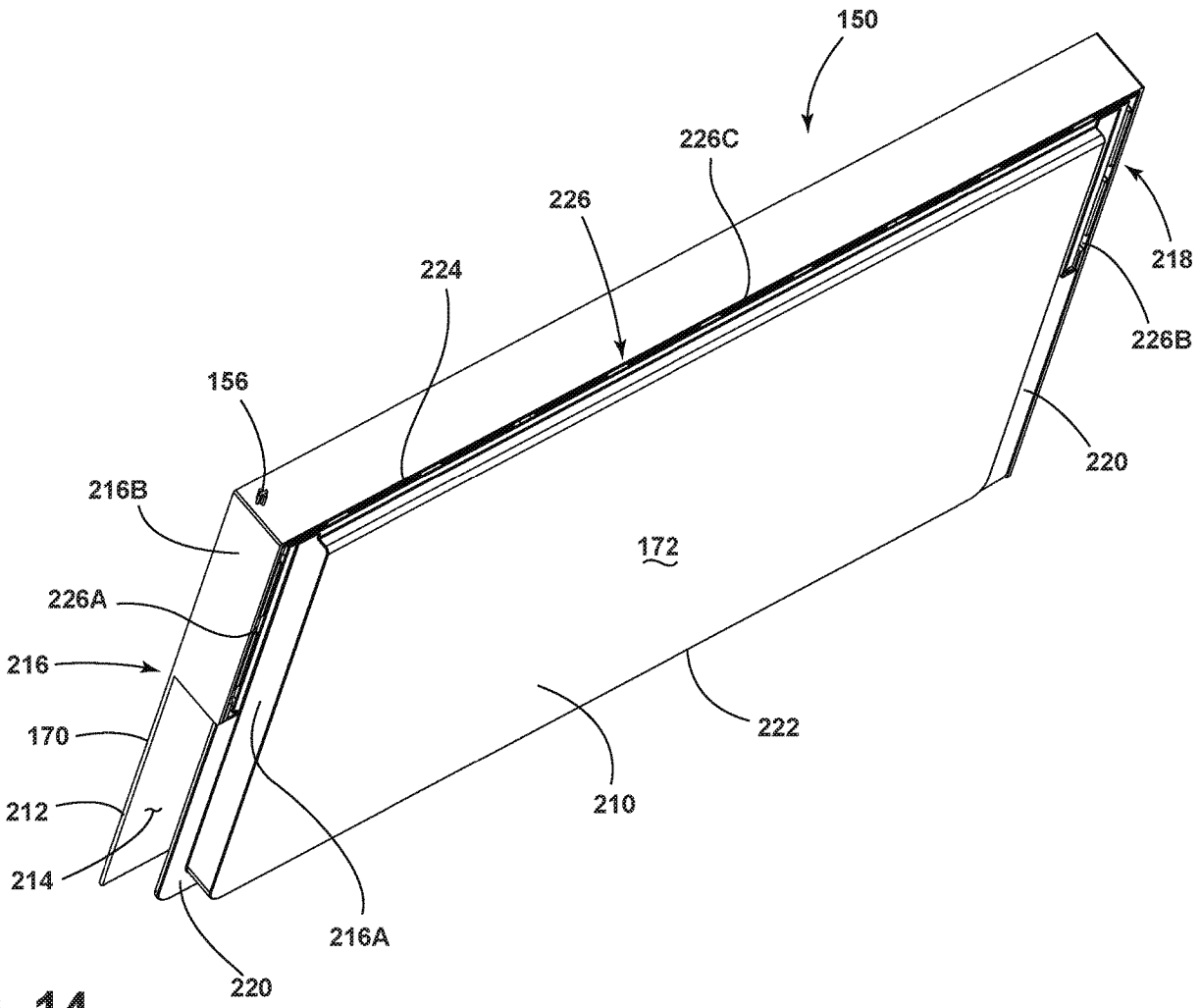
FIG. 14 is a top perspective view of the fixed member of the door of FIG. 13B.

Referring now to FIG. 14, the first or fixed member 150 is shown from a top perspective view. The first member 150 includes an inner wall 210 having inner surface 172, and further includes an outer wall 212 having exterior surface 170. The inner and outer walls 210, 212 and the exterior and inner surfaces 170, 172 are spaced-apart to define an inner cavity 214 disposed therebetween. The inner cavity 214 is contemplated to receive insulation members, such that the first member 150 is an insulated member which seals against the interior compartment 20. In this way, the interior compartment 20 can have a temperature that is different from the other compartments of the refrigerator 10 by having a door 22 that is insulated. As further shown in FIG. 14, sidewalls 216, 218 interconnect the inner and outer walls 210, 212 and are substantially the same in configuration. With specific reference to sidewall 216, the sidewall 216 is made up of first and second portions 216A, 216B which are edges of the inner and outer walls 210, 212, respectively. Portion 216A of the sidewall 216 includes an outwardly extending flange 220 which extends around a lower perimeter 222 of the first member 150. The first member 150 further includes an upper perimeter 224 having a channel 226 disposed therearound. The channel 226 includes first and second end portions 226A, 226B which downwardly extend from an intermediate portion 226C. In assembly, the portions 226A-226C of the channel 226 are configured to receive the first and second end portions 192, 194 and the intermediate portion 196, respectively, of the first seal member 190 shown in FIG. 12B. In this way, the upper perimeter 224 of the first member 150 is provided with an outwardly extending flexibly resilient seal to seal against the sealing surface 42 of the interior compartment 20. The first seal member 190 engages the channel 226 along a coupling portion of the first seal member 190, as further described below.

Figure 15:
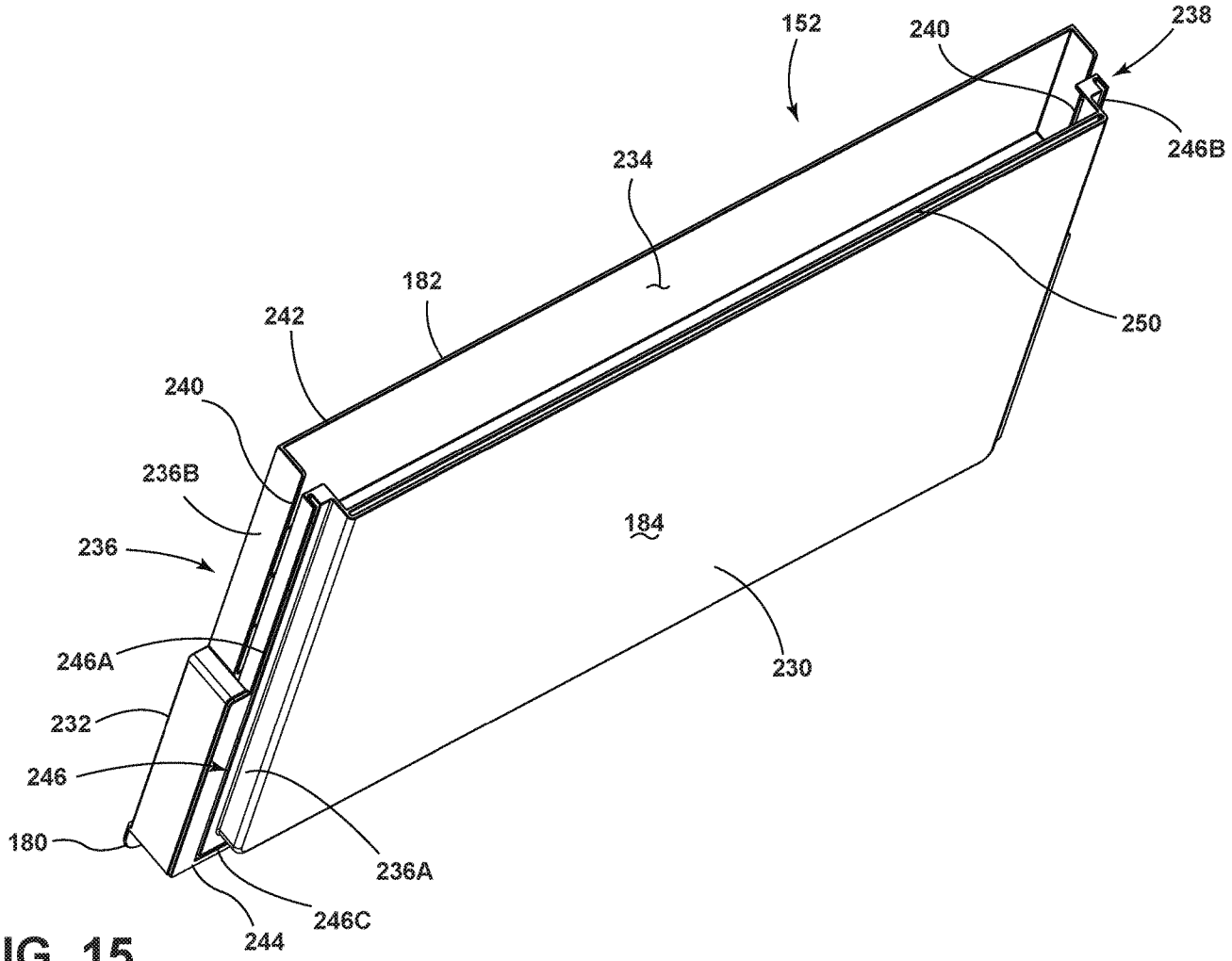
FIG. 15 is a top perspective view of the moving member of the door of FIG. 13B.
Figure 18:
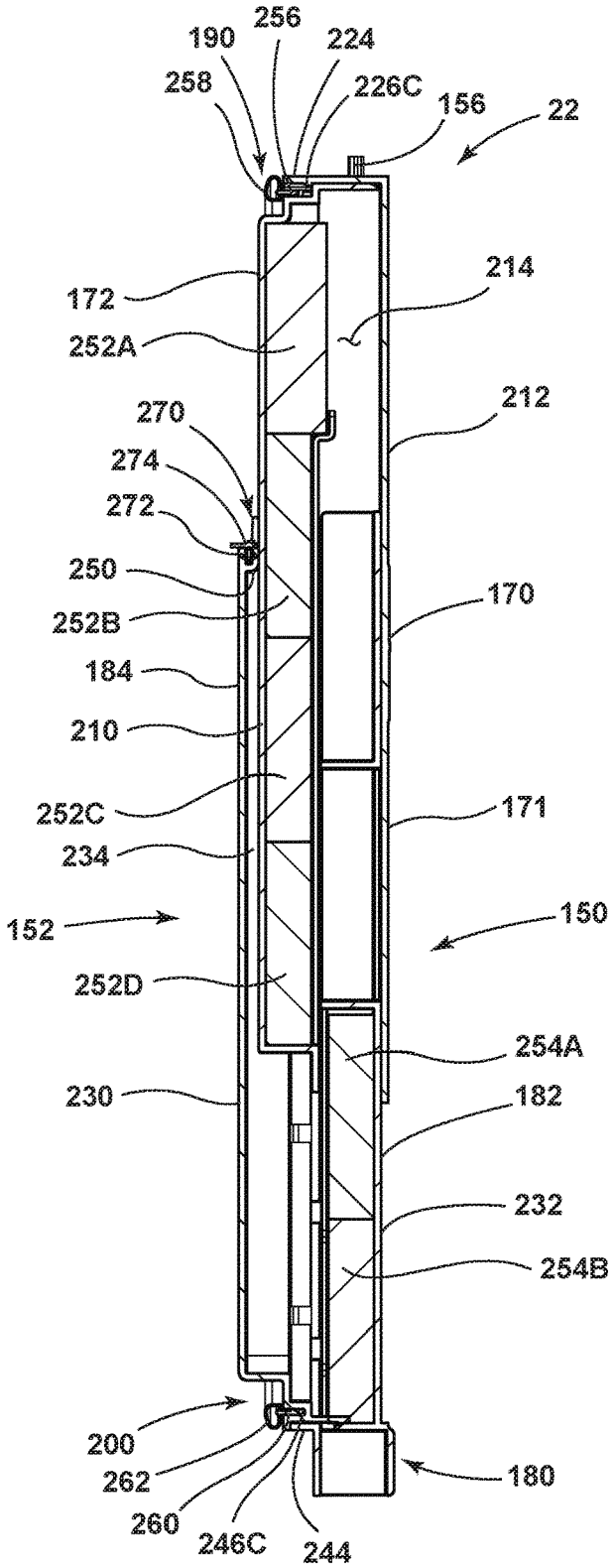
FIG. 18 is a cross-sectional view of the door of FIG. 13B taken at line XVIII.

Referring now to FIG. 15, the second or moving member 152 is shown from a top perspective view. The second member 152 includes an inner wall 230 having inner surface 184, and further includes an outer wall 232 having exterior surface 182. The inner and outer walls 230, 232 and the exterior and inner surfaces 182, 184 are spaced-apart to define an inner cavity 234 disposed therebetween. The inner cavity 234 is contemplated to receive insulation members, such that the second member 152 is an insulated member which seals against the interior compartment 20. In this way, the interior compartment 20 can have a temperature that is different from the other compartments of the refrigerator 10 by having a door 22 that is fully insulated between its first and second members 150, 152. As further shown in FIG. 15, sidewalls 236, 238 interconnect the inner and outer walls 230, 232 and are substantially the same in configuration. With specific reference to sidewall 236, the sidewall 236 is made up of first and second portions 236A, 236B which are edges of the inner and outer walls 230, 232, respectively. Between the first and second portions 236A, 236B of the sidewall 216, an elongate slot 240 is disposed. The second member 152 further includes a lower outer perimeter 244 having a channel 246 disposed therearound. The channel 246 includes first and second end portions 246A, 246B which upwardly extend from an intermediate portion 246C. In assembly, the portions 246A-246C of the channel 246 are configured to receive the first and second end portions 202, 204 and the intermediate portion 206, respectively, of the second seal member 200 shown in FIG. 12B. In this way, the lower outer perimeter 244 of the second member 152 is provided with an outwardly extending flexibly resilient seal to seal against the sealing surface 42 of the interior compartment 20. The second seal member 200 engages the channel 246 along a coupling portion of the second seal member 200 as further described below. As further shown in FIG. 15, the second or moving member 152 includes an upper channel 250 disposed transversely on an upper portion of the inner wall 230 which is also configured to receive a seal member, such that the inner surface 184 of the second member 152 can seal against the inner surface 184 of the second member 152 as the moving member 152 moves vertically relative to the second member 152. The transverse seal member 270 received in upper channel 250 is best shown in FIGS. 16 and 18 and further described below.

Figure 16:
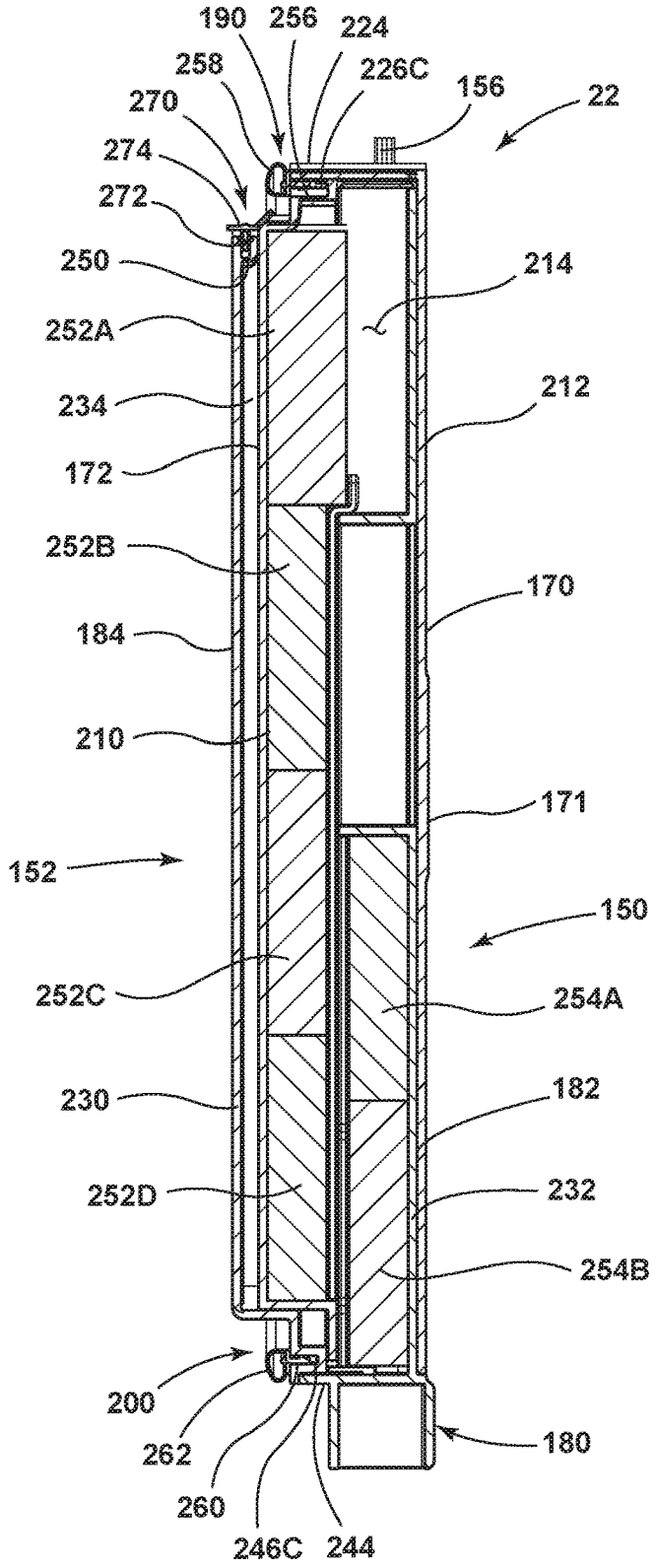
FIG. 16 is a cross-sectional view of the door of FIG. 12B taken at line XVI.

Referring now to FIG. 16, a cross-section of door 22 is shown, wherein the second member 152 is slidably coupled to the first member 150. In the coupling of the first member 150 to the second member 152, the inner wall 210 of the first member 150 is shown received within the inner cavity 234 of the second member 152, which, as noted above, is defined between the inner and outer walls 230, 232 of the second member 152. Similarly, the inner wall 230 of the second member 152 is shown received within the inner cavity 214 of the first member 150 which, as noted above, is defined between the inner and outer walls 210, 212 of the first member 150. Insulating members 252A-252D are shown disposed within the inner cavity 214 of the first member 150. Thus, the inner wall 210 of the first member 150 is telescopingly received in the inner cavity 234 of the second member 152, while the inner wall 230 of the second member 152 is telescopingly received in the inner cavity 214 of the first member 150, as the second member 152 moves relative to the first member 150. Insulating members 254A and 254B are shown disposed within the inner cavity 234 of the second member 252 for movement therewith. Thus, the insulating members 252A-252D are disposed within the inner cavity 214 the first member 150, such that these insulating members are fixed vertically in position, while insulating members 254A, 254B (disposed within the inner cavity 234 of the second member 152) move vertically with the second member 252 between the retracted and expanded positions. The insulating members 252A-252D and 254A, 254B can be any type of insulating member, such as foam panels. Further, it is contemplated that the inner cavity 214 the first member 150 and the inner cavity 234 of the second member 152 may each include a single insulating member, as opposed to having multiple insulating members disposed therein.

As further shown in FIG. 16, the first seal member 190 of the first member 150 of the door 22 includes a coupling portion 256 that is coupled to channel portion 226C disposed around the upper perimeter 224 of the first member 150. The first seal member 190 further includes a flexibly resilient seal portion 258 coupled to the coupling portion 256. Thus, while the coupling portion 256 couples to the channel portion 226C, the seal portion 258 outwardly extends to seal against the sealing surface 42 of the interior compartment 20. Similarly, second seal member 200 includes a coupling portion 260 and a seal portion 262, wherein the coupling portion 260 is coupled to channel portion 246C disposed around lower perimeter 244 of the second member 152, and the seal portion 262 outwardly extends therefrom. In this way, the second seal member 200 can seal against the lower section 42D of the sealing surface 42 of the interior compartment 20 when the door 22 is in a closed position.

As further shown in FIG. 16, a transverse seal member 270 is shown disposed within the channel 250 of the inner wall 230 of the second member 152. Specifically, the transverse seal member 270 includes a coupling portion 272 that is coupled to the channel 250 of the second member 152, and further includes a seal portion 274 in the form of an arm that seals against the inner surface 172 of the first member 150 as the second member 152 moves from the retracted position to the extended position.

Figure 17:
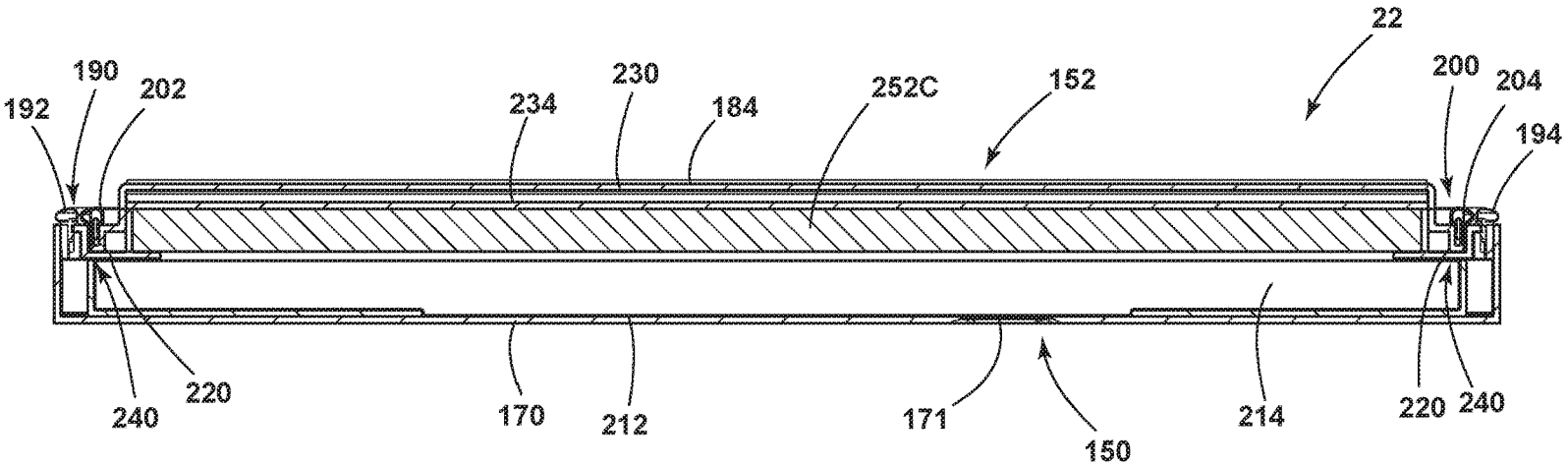
FIG. 17 is a cross-sectional view of the door of FIG. 12B taken at line XVII.

Referring now to FIG. 17, a cross-sectional view of the door 22 is shown with the door 22 in the retracted position. As shown in FIG. 17, the first and second seal members 190, 200 are shown having portion 192 overlapping with portion 202, and portion 194 overlapping with portion 204 on opposite sides of the door 22. As further shown in FIG. 17, outwardly extending flange 220 of the first fixed member 150 is shown received in slots 240 of the first and second sidewalls 236, 238 of the second member 152.

Referring now to FIG. 18, a cross-section of door 22 is shown, wherein the second member 152 is slidably coupled to the first member 150 and disposed in the extended position, as opposed to the retracted position shown in FIG. 16. The inner wall 210 of the first member 150 is still shown partially received within the inner cavity 234 of the second member 152, and the inner wall 230 of the second member 152 is still shown partially received within the inner cavity 214 of the first member 150. The insulating members 254A, 254B (disposed within the inner cavity 234 of the second member 152) have moved vertically with the second member 252 from the retracted position shown in FIG. 16 to the extended position of FIG. 18 but still overlap with insulating member 252D, such that there are no gaps in insulation in the door 22 as the door 22 expands and contracts. As further shown in FIG. 18, the first seal member 190 and the second seal member 200 are still positioned to seal against the sealing surface 42 of the interior compartment 20 when the door 22 is in a closed position and the interior compartment 20 is in an expanded condition. As further shown in FIG. 18, the transverse seal member 270 is shown having the seal portion 274 thereof sealed against the inner surface 172 of the first member 150, such that the overlapping configuration of the first and second members 150, 152 is a sealed engagement between the first and second members 150, 152 for the full movement of the second member 152 between the extended and retracted positions.

Figure 19:
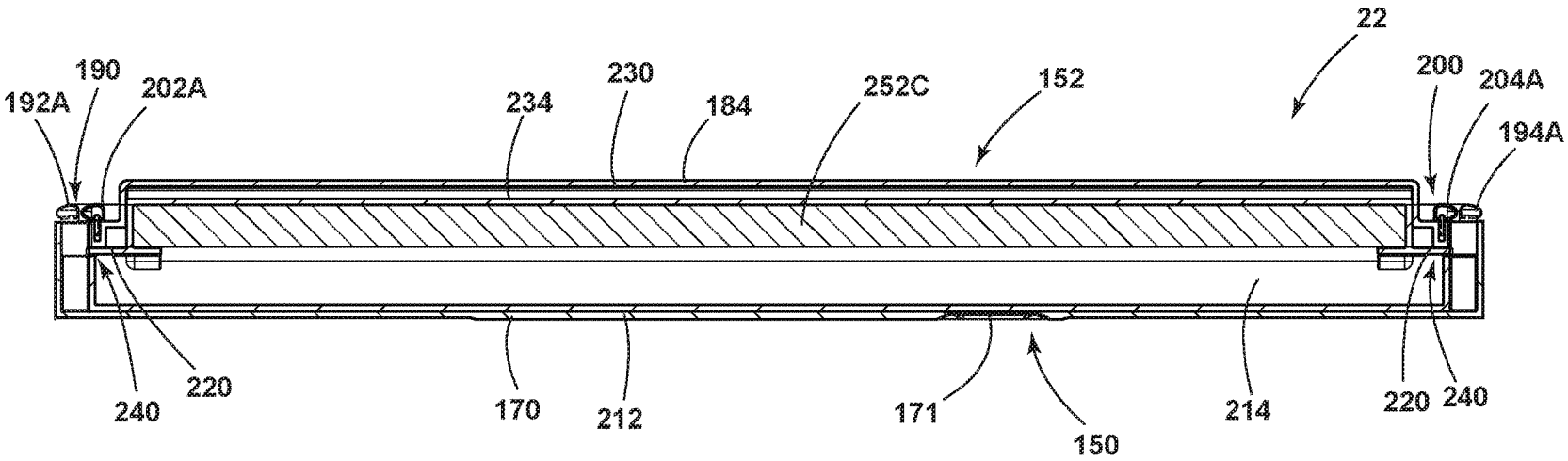
FIG. 19 is a cross-sectional view of the door of FIG. 13B taken at line XIX.

Referring now to FIG. 19, a cross-sectional view of the door 22 is shown with the door 22 in the extended position. As shown in FIG. 19, the first and second seal members 190, 200 are shown having portions 192 still overlapping with portion 202, and portion 194 still overlapping with portion 204. Thus, while the second member 152 has moved to the extended position relative to the first member 150, the overlap between portions of the first and second seal members 190, 200 remain. In this way, the expansion and contraction of the door 22 relative to the associated expansion and contraction of the interior compartment 20 provides for a full seal around the door at seal assembly 44 at all times.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerator, comprising:
a cabinet;
an adjustable wall partitioning the cabinet between first and second storage compartments, the adjustable wall having an underside with a plurality of receiving apertures extending upwardly into a body portion of the adjustable wall;
an adjustment mechanism coupled to the adjustable wall, the adjustment mechanism comprising:
a mounting portion slideably coupled to the underside of the adjustable wall between fore and aft positions; and
a retaining mechanism operably coupled to the mounting portion including a plurality of reciprocal engagement features to the plurality of receiving apertures of the adjustable wall, wherein the retaining mechanism is moveable between engaged and disengaged positions relative to the adjustable wall, and further wherein the reciprocal engagement features move upwardly and downwardly relative to the engaged and disengaged positions of the retaining mechanism, respectively.

2. The refrigerator of claim 1, wherein the cabinet includes a first sidewall with a first channel disposed on an inner surface thereof, and a second sidewall spaced-apart from the first sidewall with a second channel disposed on an inner surface thereof.

3. The refrigerator of claim 2, wherein the mounting portion includes first and second support guides extending downwardly from opposite sides of the mounting portion, wherein the first and second support guides are slideably received in the first and second channels of the cabinet, respectively.

4. The refrigerator of claim 3, wherein the first and second channels are inclined channels, and further wherein each channel includes a downward angle from a front first portion of the channel to a rear second portion of the channel.

5. The refrigerator of claim 4, wherein fore and aft movement of the mounting portion along the underside of the adjustable wall causes vertical movement of the first and second support guides within the first and second channels, such that the adjustable wall is fully raised when the mounting portion is in the fore position, and the adjustable wall is fully lowered when the mounting portion is in the aft position.

6. The refrigerator of claim 5, wherein the plurality of receiving apertures disposed on the underside of the adjustable wall includes a forward set of receiving apertures disposed on the underside of the adjustable wall for retaining the mounting portion in the fore position, and further includes a rearward set of receiving apertures disposed on the underside of the adjustable wall for retaining the mounting portion in the aft position.

7. The refrigerator of claim 6, wherein the plurality of receiving apertures disposed on the underside of the adjustable wall further includes one or more intermediate sets of receiving apertures disposed between the forward set of receiving apertures and the rearward set of receiving apertures on the underside of the adjustable wall for retaining the mounting portion in one or more intermediate positions between the fore and aft positions.

8. The refrigerator of claim 1, including:

one or more biasing mechanisms coupled between the mounting portion and the retaining mechanism, wherein the one or more biasing mechanisms bias the reciprocal engagement features of the retaining mechanism upward towards the engaged position of the retaining mechanism.

9. A refrigerator, comprising:

a cabinet having first and second sidewalls spaced-apart from one another;

an adjustable wall disposed within the cabinet and configured for vertical movement therein, the adjustable wall including one or more retaining slots on an underside thereof, wherein the one or more retaining slots extend upwardly into a body portion of the adjustable wall;

an adjustment mechanism coupled to an underside of the adjustable wall, the adjustment mechanism comprising:

a mounting portion slideably coupled to the underside of the adjustable wall between fore and aft positions and slideably coupled to the first and second sidewalls of the cabinet between raised and lowered positions;

a sliding bracket operably coupled to the mounting portion, wherein the sliding bracket is operable between first and second positions relative to the adjustable wall; and one or more retaining blocks selectively engaged by the sliding bracket, wherein the one or more retaining blocks move upwardly to engage with the one or more retaining slots of the adjustable wall when the sliding bracket is in the first position, and further wherein the one or more retaining blocks move downwardly to disengage the one or more retaining slots of the adjustable wall when the sliding bracket is moved from the first position to the second position.

10. The refrigerator of claim 9, wherein the one or more retaining slots disposed on the underside of the adjustable wall include multiple sets of retaining slots spaced-apart in predetermined positions on the underside of the adjustable wall.

11. The refrigerator of claim 9, including:

one or more biasing mechanisms coupled between the mounting portion and the one or more retaining blocks, wherein the one or more biasing mechanisms bias the one or more retaining blocks upward towards engagement with the one or more retaining slots of the adjustable wall.

12. The refrigerator of claim 10, wherein the one or more retaining blocks include first and second retaining blocks, and further wherein the multiple sets of retaining slots disposed on the underside of the adjustable wall include first and second retaining slots configured to receive the first and second retaining blocks when the sliding bracket is in the first position.

13. The refrigerator of claim 9, including:

first and second downwardly angled channels disposed on the first and second sidewalls of the cabinet, respectively.

14. The refrigerator of claim 13, including:

first and second support guides downwardly extending from opposite ends of the mounting portion, wherein the first and second support guides are slideably received in the first and second downwardly angled channels, respectively.

15. A refrigerator, comprising:

a cabinet including a first sidewall with a first channel disposed on an inner surface thereof, and a second sidewall spaced-apart from the first sidewall with a second channel disposed on an inner surface thereof;

an adjustable wall partitioning the cabinet between first and second storage compartments;

an adjustment mechanism coupled to the adjustable wall, the adjustment mechanism comprising:

a mounting portion slideably coupled to an underside of the adjustable wall between fore and aft positions, the mounting portion including first and second support guides downwardly and rearwardly extending from opposite sides of the mounting portion, wherein the first and second support guides are slideably received in the first and second channels of the first and second sidewalls, respectively, between raised and lowered positions.

16. The refrigerator of claim 15, wherein the adjustable wall includes a plurality of engagement features disposed on the underside thereof.

17. The refrigerator of claim 16, including:

a retaining bar pivotally coupled to the mounting portion between engaged and disengaged positions, wherein the retaining bar includes one or more engagement features configured to be received in one or more of the engagement features of the plurality of engagement features disposed on the underside of the adjustable wall when in the retaining bar is in the engaged position.

18. The refrigerator of claim 17, including:

one or more biasing mechanisms coupled between the mounting portion and the retaining bar, wherein the one or more biasing mechanisms bias the retaining bar towards the engaged position.

19. The refrigerator of claim 18, wherein the one or more engagement features of the retaining bar includes first and second upwardly extending ends, and further wherein the one or more engagement features of the plurality of engagement features disposed on the underside of the adjustable wall includes multiple sets of receiving apertures configured to receive the first and second ends of the retaining bar when the retaining bar is in the engaged position.

20. The refrigerator of claim 15, wherein the first and second channels are inclined channels, and further wherein the adjustable wall is in a fully raised position when the mounting portion of the adjustment mechanism is in the fore position, and further wherein the adjustable wall is in a fully lowered position when the mounting portion of the adjustment mechanism is in the aft position.

* * * * *